US010682569B1

(12) United States Patent
Vale

(10) Patent No.: US 10,682,569 B1
(45) Date of Patent: Jun. 16, 2020

(54) GOLF GAME SYSTEM

(71) Applicant: Tim Vale, Guilford, CT (US)

(72) Inventor: Tim Vale, Guilford, CT (US)

( * ) Notice: Subject to any disclaimer, the term of this patent is extended or adjusted under 35 U.S.C. 154(b) by 0 days.

(21) Appl. No.: 16/536,816

(22) Filed: Aug. 9, 2019

(51) Int. Cl.

| | |
|---|---|
| ***A63F 7/06*** | (2006.01) |
| ***A63B 24/00*** | (2006.01) |
| ***A63B 69/36*** | (2006.01) |
| ***A63B 71/06*** | (2006.01) |

(52) U.S. Cl.
CPC ..... *A63F 7/0628* (2013.01); *A63B 24/0003* (2013.01); *A63B 24/0021* (2013.01); *A63B 69/3658* (2013.01); *A63B 71/0622* (2013.01); *A63B 2024/0034* (2013.01); *A63B 2024/0043* (2013.01); *A63B 2071/0638* (2013.01); *A63B 2220/35* (2013.01)

(58) Field of Classification Search
CPC ..... A63F 7/0628; A63B 24/0003; A63B 71/0622; A63B 24/0021; A63B 69/3658; A63B 2220/35; A63B 2024/0034; A63B 2071/0638; A63B 2024/0043
See application file for complete search history.

(56) References Cited

U.S. PATENT DOCUMENTS

| | | | | |
|---|---|---|---|---|
| 3,501,152 | A | 3/1970 | Conklin | |
| 4,836,551 | A | 6/1989 | LaSalle | |
| 5,221,082 | A * | 6/1993 | Curshod | A63B 24/0021 434/252 |
| 5,226,660 | A | 7/1993 | Curchod | |
| 8,409,024 | B2 | 4/2013 | Marty | |
| 9,984,587 | B2 | 5/2018 | Shultz | |
| 10,204,456 | B2 | 2/2019 | Kudirka | |
| 2001/0034272 | A1 * | 10/2001 | Sobol | A63B 24/0021 473/278 |
| 2012/0184340 | A1 * | 7/2012 | Jang | A63B 67/02 463/2 |
| 2018/0290040 | A1 * | 10/2018 | Korpach | G09B 19/0038 |
| 2019/0299057 | A1 * | 10/2019 | Vollbrecht | G06T 7/246 |

FOREIGN PATENT DOCUMENTS

| | | | |
|---|---|---|---|
| KR | 20020092266 | A | 12/2002 |

* cited by examiner

*Primary Examiner* — Jeffrey S Vanderveen
(74) *Attorney, Agent, or Firm* — Michael A. Blake

(57) ABSTRACT

A golf game system comprising: a golf simulator, the golf simulator comprising a plurality of virtual tee boxes adjacent to or on a virtual fairway; an outdoor shortened golf hole programmed into the golf simulator located on or near the outdoor shortened golf hole, the outdoor golf hole comprising: fairway landing area; rough landing areas; an approach area adjacent to the fairway landing area; a green adjacent to the approach area; a cup in the green; a plurality of mats located on the landing areas; where the golf simulator is configured to allow a player simulate a drive of a golf ball out of a simulated tee box onto the landing area, and the golf simulator calculates where on the landing area the ball should be placed after the drive, and the golf simulator informs the player where to place the ball on the landing area. A golf game system that assigns a precisely matched tee locations based on golfer swing data and is not limited to a select number of predetermined tee boxes. A golf system that allows a player to play the golf course with modified golf ball speed, golf ball side spin and golf swing path to better match a golfer's skill level to the golf course being played on and/or a golfer's playing partners.

29 Claims, 16 Drawing Sheets

7 iron Distance

| Driver Distance | 32 | 29 | 26 | 23 | 20 |
|---|---|---|---|---|---|
| | 76 | 76 | 76 | 76 | 76 |
| | 76 | 76 | 76 | 75 | 75 |
| | 76 | 76 | 75 | 75 | 75 |
| | 76 | 75 | 75 | 75 | 74 |
| | 75 | 75 | 75 | 74 | 74 |
| | 75 | 74 | 74 | 74 | 74 |
| | 74 | 74 | 74 | 73 | 73 |
| | 74 | 74 | 73 | 73 | 73 |
| | 73 | 73 | 73 | 72 | 72 |
| | 73 | 72 | 72 | 72 | 72 |
| | 72 | 72 | 72 | 71 | 71 |
| | 72 | 71 | 71 | 71 | 71 |
| | 71 | 71 | 71 | 70 | 70 |
| | 71 | 70 | 70 | 70 | 70 |
| | 70 | 70 | 70 | 69 | 69 |
| | 70 | 69 | 69 | 69 | 69 |
| | 69 | 69 | 69 | 68 | 68 |
| | 69 | 68 | 68 | 68 | 68 |
| | 68 | 68 | 68 | 67 | 67 |
| | 68 | 67 | 67 | 67 | 67 |
| | 67 | 67 | 67 | 66 | 66 |
| | 67 | 66 | 66 | 66 | 66 |
| | 66 | 66 | 66 | 65 | 65 |
| | 66 | 65 | 65 | 65 | 65 |
| | 65 | 65 | 65 | 64 | 64 |
| | 65 | 64 | 64 | 64 | 63 |
| | 64 | 64 | 63 | 63 | 62 |
| | 63 | 63 | 62 | 62 | 61 |
| | 62 | 62 | 61 | 61 | 60 |
| | 61 | 61 | 60 | 60 | 59 |
| | 60 | 60 | 59 | 59 | 58 |
| | 59 | 59 | 58 | 58 | 57 |
| | 58 | 58 | 57 | 57 | 56 |
| | 57 | 57 | 56 | 55 | 55 |
| | 56 | 56 | 55 | 55 | 54 |
| | 55 | 55 | 54 | 54 | 53 |
| | 54 | 54 | 53 | 53 | 52 |
| | 53 | 53 | 52 | 52 | 51 |
| | 52 | 52 | 51 | 51 | 50 |
| | 51 | 51 | 50 | 50 | 49 |
| | 50 | 50 | 49 | 49 | 48 |
| | 49 | 49 | 48 | 48 | 47 |
| | 48 | 48 | 47 | 47 | 46 |
| | 47 | 47 | 46 | 46 | 45 |
| | 46 | 46 | 45 | 45 | 44 |
| | 45 | 45 | 44 | 44 | 43 |
| | 44 | 44 | 43 | 43 | 42 |
| | 43 | 43 | 42 | 42 | 41 |
| | 42 | 42 | 41 | 41 | 40 |
| | 41 | 41 | 40 | 40 | 39 |
| | 40 | 40 | 39 | 39 | 38 |
| | 39 | 39 | 38 | 38 | 37 |
| | 38 | 38 | 37 | 37 | 36 |
| | 37 | 37 | 36 | 36 | 35 |
| | 36 | 36 | 35 | 35 | 34 |
| | 36 | 35 | 35 | 34 | 34 |
| | 36 | 35 | 34 | 34 | 33 |
| | 35 | 35 | 34 | 33 | 33 |
| | 35 | 34 | 34 | 33 | 32 |
| | 34 | 34 | 33 | 33 | 32 |
| | 34 | 33 | 33 | 32 | 32 |
| | 34 | 33 | 32 | 32 | 31 |
| | 33 | 33 | 32 | 31 | 31 |
| | 33 | 32 | 32 | 31 | 30 |
| | 32 | 32 | 31 | 31 | 30 |

Green

White

Orange

Red

Yellow

Purple

Fig. 14

| Driver Distance | 7 Iron Distance | Total | Tee Box Color | Infinite Tee Rating |
|---|---|---|---|---|
| **314+** | **190+** | **505+** | use rating | **100** |
| 312 | 188 | 500 | use rating | 98 |
| 309 | 186 | 495 | use rating | 96 |
| 306 | 184 | 490 | use rating | 94 |
| 303 | 182 | 485 | Black | 92 |
| 300 | 180 | 480 | Black | 90 |
| 295 | 175 | 470 | Black | 89 |
| 290 | 170 | 460 | Black | 88 |
| 285 | 165 | 450 | Black | 87 |
| 280 | 160 | 440 | Black | 86 |
| 275 | 155 | 430 | Blue | 85 |
| 270 | 150 | 420 | Blue | 84 |
| 265 | 145 | 410 | Blue | 83 |
| 260 | 140 | 400 | Blue | 82 |
| 255 | 135 | 390 | Blue | 81 |
| 250 | 130 | 380 | Blue | 80 |
| 245 | 125 | 370 | Green | 79 |
| 240 | 120 | 360 | Green | 78 |
| 235 | 115 | 350 | Green | 77 |
| 230 | 110 | 340 | Green | 76 |
| 225 | 105 | 330 | Green | 75 |
| 220 | 100 | 320 | Green | 74 |
| 215 | 95 | 310 | White | 73 |
| 210 | 90 | 300 | White | 72 |
| 205 | 85 | 290 | White | 71 |
| 200 | 80 | 280 | White | 70 |
| 195 | 75 | 270 | White | 69 |
| 190 | 70 | 260 | White | 68 |
| 185 | 65 | 250 | Orange | 67 |
| 180 | 60 | 240 | Orange | 66 |
| 175 | 55 | 230 | Orange | 65 |
| 170 | 50 | 220 | Orange | 64 |
| 165 | 50 | 215 | Orange | 63 |
| 160 | 50 | 210 | Orange | 62 |
| 155 | 50 | 205 | Red | 61 |
| 150 | 50 | 200 | Red | 60 |
| 145 | 50 | 195 | Red | 59 |
| 140 | 50 | 190 | Red | 58 |
| 135 | 50 | 185 | Red | 57 |
| 130 | 50 | 180 | Red | 56 |
| 125 | 50 | 175 | Yellow | 55 |
| 120 | 50 | 170 | Yellow | 54 |
| 115 | 50 | 165 | Yellow | 53 |
| 110 | 50 | 160 | Yellow | 52 |
| 105 | 50 | 155 | Yellow | 51 |
| 100 | 50 | 150 | Purple | 50 |
| 95 | 50 | 145 | Purple | 49 |
| 90 | 50 | 140 | Purple | 48 |
| 85 | 50 | 135 | Purple | 47 |
| 80 | 50 | 130 | Purple | 46 |
| 75 | 50 | 125 | use rating | 45 |
| 70 | 50 | 120 | use rating | 44 |
| 65 | 50 | 115 | use rating | 43 |
| 60 | 50 | 110 | use rating | 42 |
| 55 | 50 | 105 | use rating | 41 |
| 50 | 50 | 100 | use rating | 40 |
| 48 | 47 | 95 | use rating | 39 |
| 46 | 44 | 90 | use rating | 38 |
| 44 | 41 | 85 | use rating | 37 |
| 42 | 38 | 80 | use rating | 36 |
| 40 | 35 | 75 | use rating | 35 |
| 38 | 32 | 70 | use rating | 34 |
| 36 | 29 | 65 | use rating | 33 |
| 34 | 26 | 60 | use rating | 32 |
| 32 | 23 | 55 | use rating | 31 |
| **30** | **20** | **50** | use rating | **30** |

Fig. 15

GOLF GAME SYSTEM

TECHNICAL FIELD

The present invention relates to an improvement to a golf game, and more particularly to a game that combines the use of golf simulator and an actual golf course.

BACKGROUND

The length of time to play a 9 or 18 hole round of golf is considered too long, resulting in many people choosing not to play. Causes for this length of time include: time spent looking for lost golf balls; time spent getting from tee box to landing area; only a small percentage of time on the golf course is spent actually playing golf. Golf is very expensive making it prohibitive for many people interested in the sport. Expenses include: time, labor and equipment required to maintain large expanses of land; large quantities of chemicals, fertilizers, water and sand are used to keep course manicured; Cost of renting golf carts to get around large expansive courses; cost of lost golf balls adds up considering a premium ball costs $4 or more. This cost may be become especially high for lower skill golfers. It may be difficult for families to play golf together because it takes extra time for members of one group to play from multiple tee boxes. For example, a father my play from blue tees, mother from red, and children from children tees. This extra time very often causes backups on the golf course. In addition, golf courses generally do not provide the full array of tee boxes to accommodate the youngest beginner golfers all the way up to the longest hitting expert golfers. An extraordinary amount of physical space and maintenance costs would be required have so many tee boxes. Also the closest tee boxes would have to be in close proximity to the green therefore interfering with normal play for other golfers. Golfers playing a set of tees intended for golfers above their skill level creates delays due to more shots needed to complete (hole out) any given hole. Golf groups with golfers of varying skill level typically will choose a single set of tees (ex. white tees) to hit from to avoid extra time to play different physical tee boxes. Playing a single set of tees forces some players to play below their level and others above their level. Golf courses are not generally set up for children to play. Large, manicured golf courses may be bad for the environment and not sustainable particularly in drought sensitive areas. This is due to necessity to use large amounts of water, chemicals, fertilizer, and gas powered equipment. Full sized golf courses rely on the creation of large fairway and greenside bunkers made with large amounts of sand spread across the entire bunker to provide appropriate challenge and design elements to a golf hole. This adds maintenance cost, time to maintain during play and requires more land. Due to the need for large quantities of sand, golf course will very often choose to use lower quality sand that is harder to hit golf balls from which makes golf less enjoyable for all golfers. Full size standard golf courses rely on the creation of large man-made bodies of water to provide appropriate challenge and design elements to a golf hole. These man made bodies of water rely on groundwater as its major water supply. They add maintenance cost and environmental concerns. Inclement and unpredictable (cold or rainy) weather or inclement course conditions (soft, soggy course) reduces the number of available golf days in a season or calendar year. In the northeast, the primary golf season may start late (April) and end early (October) due to weather and course conditions. Often, golf in the fall season results in even slower play and can be frustrating as golf balls are easily lost in the leaves. On days with rain or thundershowers in the forecast, golfers often choose to avoid golfing due to unavailability of places to seek shelter on the golf course. Sand bunkers do not drain well following a day of heavy rain. Sand in bunkers erodes from side slopes, collects in deep puddles at the bottom of the bunker and becomes hard and unplayable in other locations within the bunker. This difficult conditions make golf unnecessarily punishing or else unplayable. It also adds to overall maintenance costs as a large quantity of bunkers on a golf course need to be repaired following rain storms. Young people (the next generation of golfers) are not taking to the sport and overall participation is decreasing causing concern for the future of golf. Golf courses often have employees of the golf course roaming the golf course in carts, selling food/drink to golfers. The stoppage of golf required to make the transaction on course can cause backups and delays. The stoppage of play causes delays which limits the overall number of rounds of golf played and results in lost revenue for the course and higher prices that get charged per round of golf. Golf courses are missing out on food/beverage purchases and results in lost revenue for the course and higher prices that get charged per round of golf. Additionally all golfers will attest that these carts never seem to be available when needed most. This promotes golfers to bring their own food and beverage to the course resulting in more lost income. It may be difficult to accurately identify the "Reference Point" or "Point at Which a Ball Crossed the Margin/Edge of a Hazard" when a traditional tee shot is hit into a Hazard. Identification is difficult due to the following factors: The hazard is often very far away testing the limits of a golfer's vision; the ball is often very high in the air making it difficult or impossible in a split second for a golfer to try to visualize the margin of the hazard at such height. Because of this, the reference point is very subjective and seen differently by golfers and their playing partners. Discussions and even arguments about this reference point cause delays in the game. Additionally, not knowing the precise reference point makes finding a golf ball in a hazard exceedingly difficult. Golfers spend a lot of time trying to find golf balls in a hazard in order to prevent a penalty stroke from being incurred. Existing golf courses are not set up to be able to play Night Golf. They lack lighting around the approach area and green. Even with glow balls, balls are easily lost on tee shots. It is dangerous to search for mishit tee shots in the woods as golfers cannot see and safely navigate the rough terrain. It is dangerous for golfers to have to travel such long distances between holes and between tee box and landing area in the dark.

Thus there is a need for a golf game system that overcome the above listed and other disadvantages.

SUMMARY OF THE INVENTION

The disclosed invention relates to a golf game system comprising: a golf simulator, the golf simulator comprising a plurality of virtual tee boxes adjacent to or on a virtual fairway; an outdoor shortened golf hole programmed into the golf simulator located on or near the outdoor shortened golf hole, the outdoor golf hole comprising: fairway landing area; rough landing areas; an approach area adjacent to the fairway landing area; a green adjacent to the approach area; a cup in the green; a plurality of mats located on the landing areas; where the golf simulator is configured to allow a player simulate a drive of a golf ball out of a simulated tee box onto the landing area, and the golf simulator calculates where on the landing area the ball should be placed after the drive, and the golf simulator informs the player where to place the ball on the landing area.

BRIEF DESCRIPTION OF THE DRAWINGS

The present disclosure will be better understood by those skilled in the pertinent art by referencing the accompanying drawings, where like elements are numbered alike in the several figures, in which:

FIG. 14 is page 3 of an Infinite Tee X-Y look up table of data, showing various driver/7 iron distance combinations;

FIG. 15 is a simplified Infinite Tee Box table, showing a subset of possible driver/7 iron distance combinations;

DETAILED DESCRIPTION OF THE INVENTION

Figure 1:
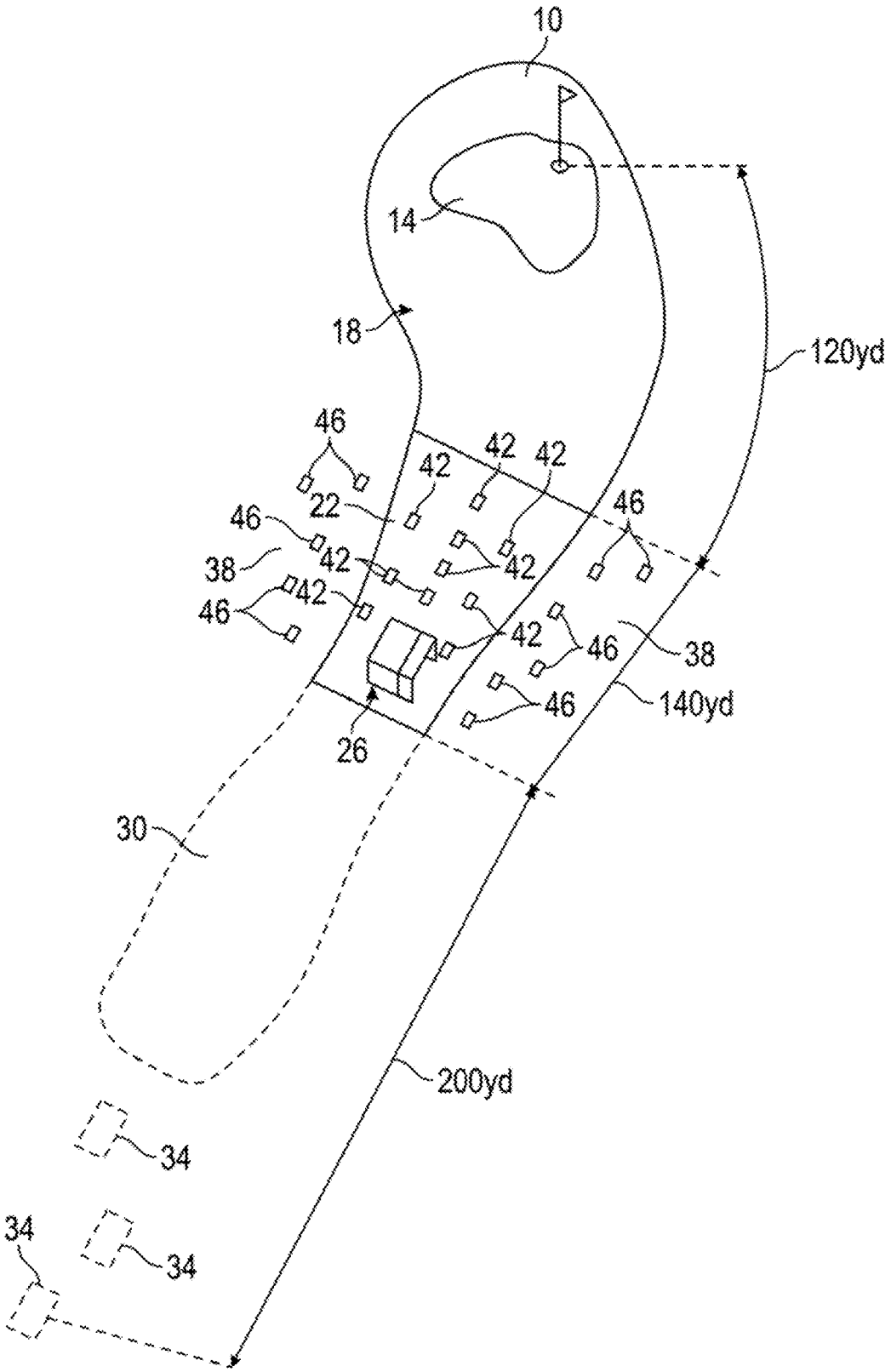
FIG. 1 is a schematic view of the golf game system.

FIG. 1 is a schematic showing the golf game system. A shortened golf hole 10 is shown. The golf hole comprises a green 14, approach area 18, fairway landing area 22, and simulator building 26. In dashed lines are shown a virtual fairway 30, and a virtual tee boxes 34. The virtual fairway 30 and virtual tee boxes 34 exist in the golf simulator virtual environment. In one embodiment, the shortened golf hole 10 may have a landing area with a length of about 140 yards, and an approach area with a length of about 120 yards. A plurality of mats 42 are shown in the fairway landing area 22, and a plurality of mats 46 are shown in the rough landing area 38. In this disclosure mats are one type of indicia. However, indicia may include flags, plaques, signs, and markers. The indicia may be color coded, or having alphanumeric indicia to distinguish the different indicia. Although many embodiments of the invention use mats as the indicia, a person of ordinary skill in the art will understand that any suitable indicia may be used instead of mats throughout this document. On shortened golf holes using mats as the indicia, the fairway grass may be longer than normal, because one would be golfing off the mats, and the length of the grass would not be a factor in the golf shot. Thus costs of maintaining the actual golf course would be lessened. Similarly, on shortened golf holes using mats as the indicia, the rough grass may be longer than normal, because one would be golfing off the mats, and the length of the grass would not be a factor in the golf shot, thus costs of maintaining the actual golf course would be lessened.

Fairway landing area 22 and rough landing area 38 may be referred to collectively as landing area in portions of this application. The mats may be of sufficient size for a golfer to have enough area to take a stance on the mat and hit the golf ball off of the same mat. The mat may be about 4' by about 4' or larger. Alternatively, a very small mat could be used, but would require the golfer to stand on the surrounding turf which. Mats in the fairway landing area may be thick mats comprised of about ½ inch long woven nylon (or similar) material and sufficient padding underlayment to allow for a downward strike of the ball similar to what could be achieved on a traditional golf fairway. Mats in the rough landing area may be generally thinner mats with shorter woven nylon (or similar) material and less padding intended to limit the quality of strike of the ball. Alternatively, significantly longer woven nylon (or other material designed to increase friction between the golf club and ball) may be used to also limit the quality of strike of the ball.

Figure 2:
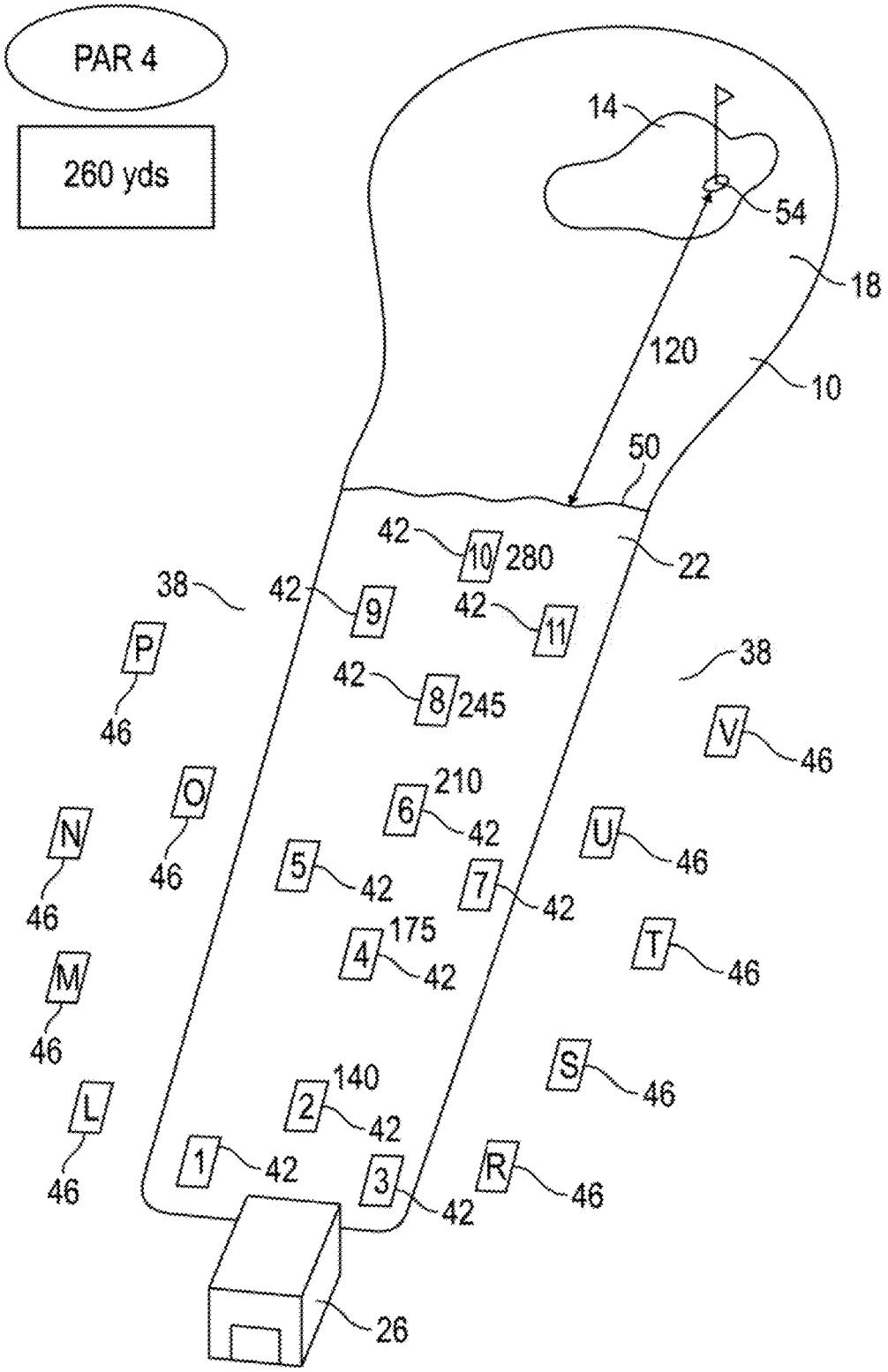
FIG. 2 is a more detailed schematic view of the golf game system on a Par 4 hole.

FIG. 2 is a more detailed view of the shortened golf hole 10. In this view, the mats 42 in the fairway landing area 22 can be seen with markings on them. In this embodiment, the markings may be numbers, 1 through 10. Similarly, the mats 46 in the rough landing area 38 may also have markings, in this embodiment; the markings are alphabetical, L, M, N, O, P, R, S, T, U and V. FIG. 2 shows a shortened golf hole representing a par 4 hole, with a 260 yard distance from the virtual tee box to the hole. Thus, mat 42, with number 2 on it, may represent where a ball needs to be placed if a drive in the simulator indicates a drive of around 140 yards. Mat 42, with number 4 on it, represents where a ball should be placed if the drive is about 175 yards. Mat 42, with the number 6 on it, represents the location of a ball if the drive is about 210 yards, mat 42, with the number 8 on it, represents the location of a ball if the drive is about 245 yards, and mat 42, with the number 10 on it represents the location of a ball if the drive is about 280 yards. The distance from the border 50 of the landing area and approach area to the cup 54 may be about 120 yards in this embodiment. If the drive in the simulator indicates the ball drifts to the left or right, than the ball may be located on mats 1, 3, 5, 7, 9, 10 depending on the length of the drive. Similarly, if the drive in the simulator indicates the drive going into the rough landing area, the then ball may need to be placed on mats L, M, N, O, P, R, S, T, U or V depending on where the virtual ball lands in the simulator. Thus, once the player hits a tee shot in the simulator building, using the golf simulator, the golf simulator calculates where the virtual ball lands. Then the system informs the player on which mat to place his or her golf ball or gives an exact location relative to the mat to place his or her golf ball, and then the player plays the remainder of the hole on the actual (as opposed to the virtual) golf hole 10.

Figure 3:
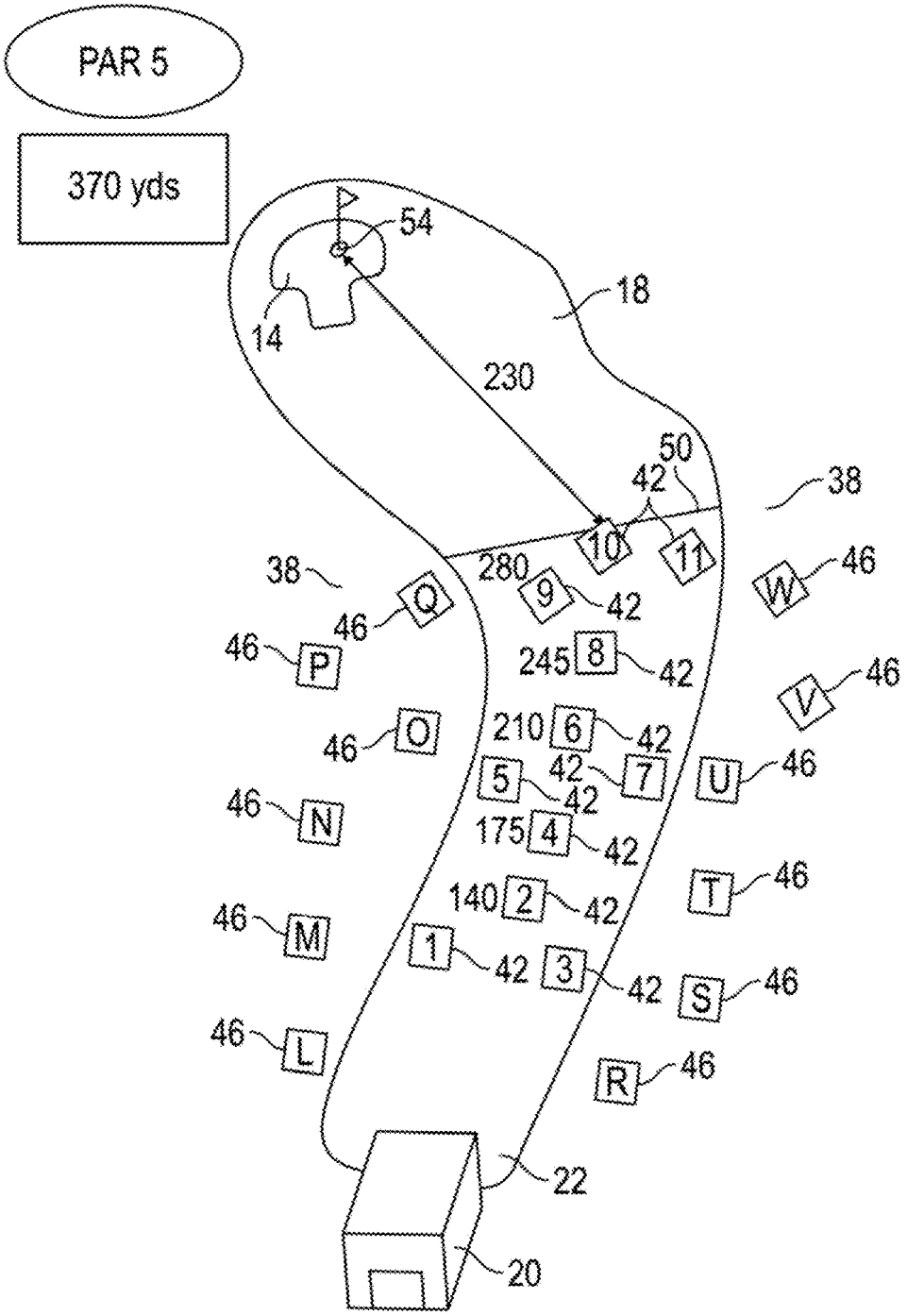
FIG. 3 is a detailed schematic view of the golf game system on a Par 5 hole.

FIG. 3 shows a golf hole representing a par 5 hole, with a 510 yard distance from the virtual tee box to the cup 54 and a 370 yard distance from the simulator shed 26 to the cup 54. In this view, the mats 42 in the fairway landing area 22 can be seen with markings on them. In this embodiment, the markings may be numbers, 1 through 10. Similarly, the mats 46 in the rough 38 may also have markings, in this embodiment; the markings are alphabetical, L, M, N, O, P, R, S, T, U, V and W. The distance from the virtual tee box to the cup 54 may be about 370 yards. Thus, mat 42, with number 2 on it, may represent where a ball needs to be placed if a drive in the simulator indicates a drive of around 140 yards. Mat 42, with number 4 on it, represents where a ball should be placed if the drive is about 175 yards. Mat 42, with the number 6 on it, represents the location of a ball if the drive is about 210 yards, mat 42, with the number 8 on it, represents the location of a ball if the drive is about 245 yards, and mat 42, with the number 10 on it represents the location of a ball if the drive is about 280 yards. The distance from the border 50 of the landing area and approach area to the cup 54 may be about 230 yards in this embodiment.

Figure 4:
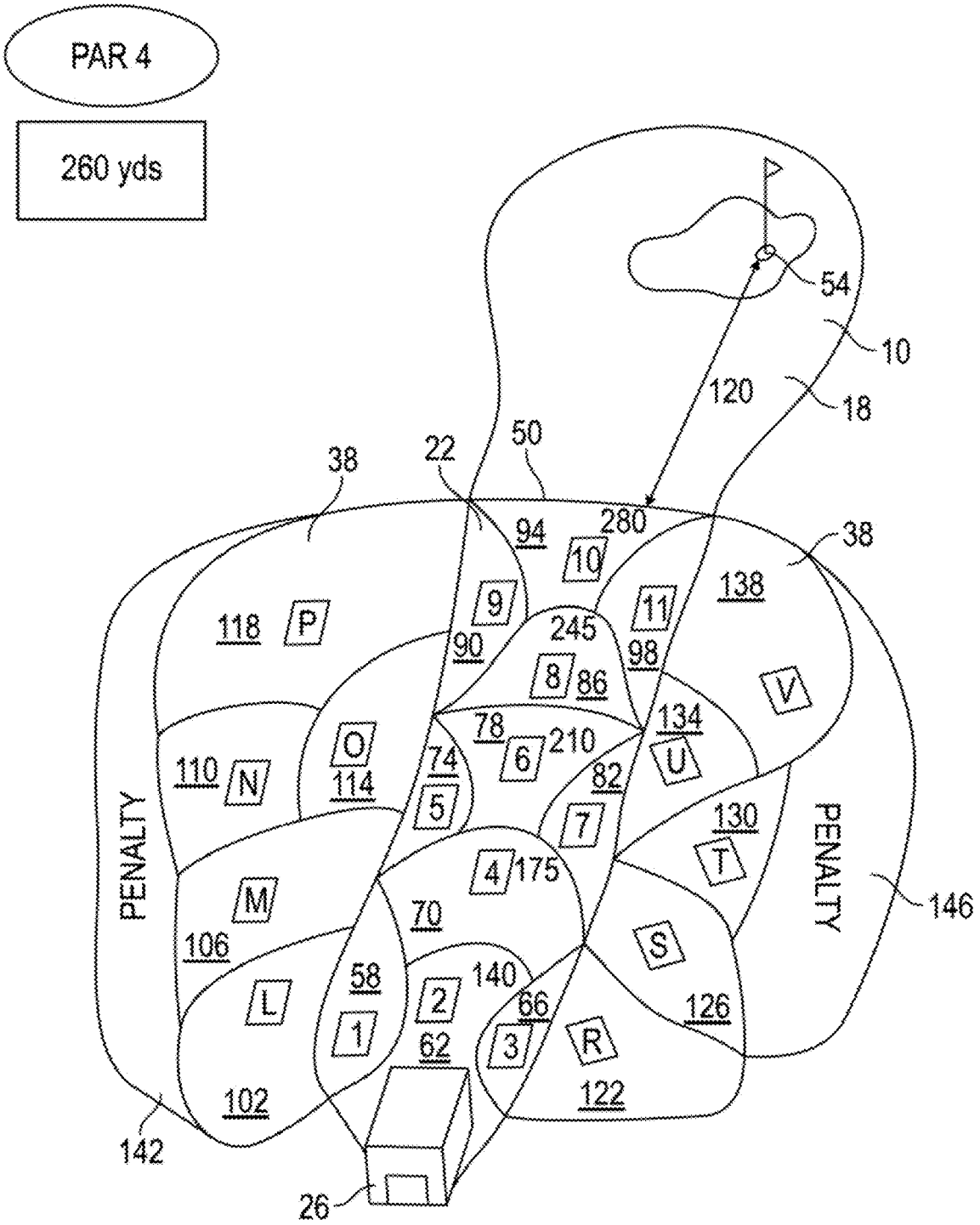
FIG. 4 is a schematic view of another embodiment of the golf game system.

FIG. 4 shows a par 4 shortened golf hole 10. In this embodiment, each of the mats 42, 46 is associated with its own zone. Thus, in the fairway landing area 22, mat 42, with the number 1 on it, is associated with zone one 58, mat with the number 2 is associated with zone two 62, mat with number 3 is associated with zone three 66, mat with number 4 is associated with zone four 70, mat with number 5 is associated with zone five 74, mat with number 6 is associated with zone six 78, mat with number 7 is associated with zone seven 82, mat with number 8 is associated with zone eight 86, mat with number 9 is associated with zone nine 90, mat with number 10 is associated with zone ten 94. Similarly in the rough 38, mat 46, with the identifier L on it, is associated with zone L 102, mat with identifier M is associated with zone M 106, mat with N is associated with zone N 110, mat with O is associated with zone O 114, mat with P is associated with zone P 118, mat with R is associated with zone R 122, mat with S is associated with zone S 126, mat with T is associated with zone T 130, mat with U is associated with zone U 134, mat with V is associated with zone V 138. There may also be a first penalty area 142 and a second penalty area 146 adjacent to the roughs 38.

Figure 5:
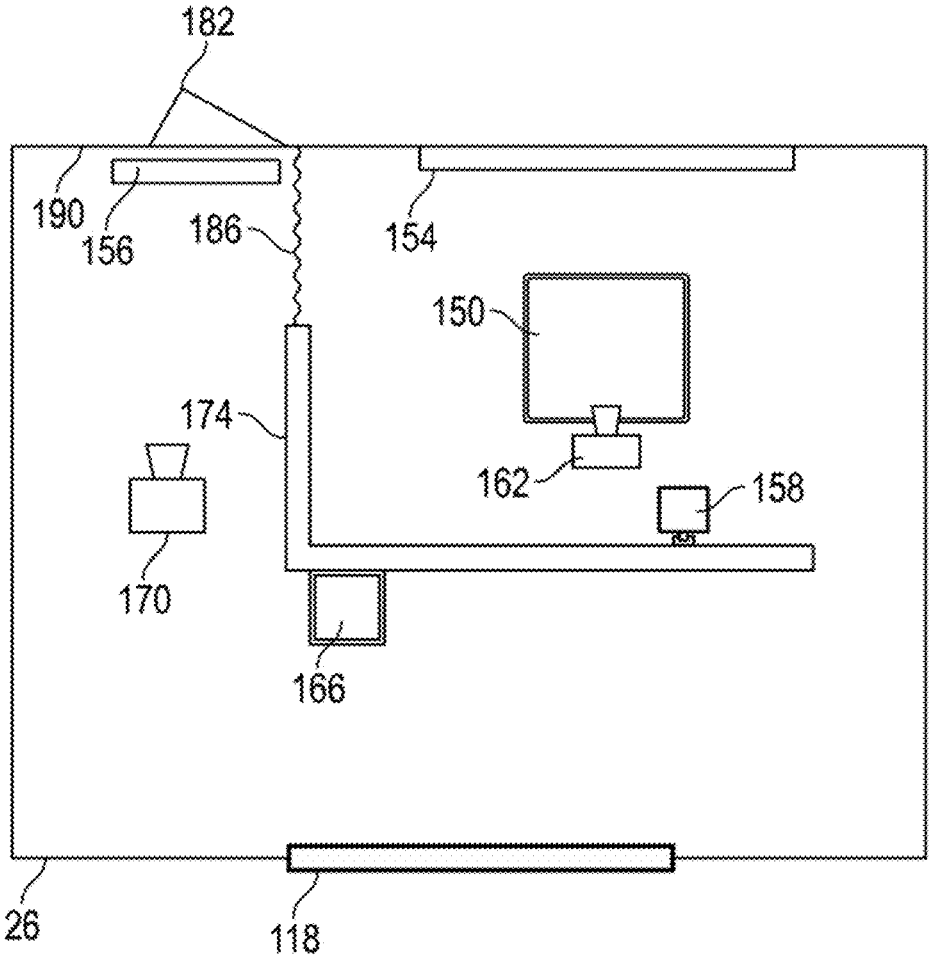
FIG. 5 is a schematic view of a simulator building.

FIG. 5 shows a top see-through view of one embodiment of the simulator building 26. In this embodiment, the simulator building may comprise a tee mat 150, a screen 154, and a sensor 158. When teeing off at a hole, the player steps on the tee mat 150, and strikes a golf ball towards the screen 154. The sensor 158 measures the trajectory of the ball to determine where on the fairway landing area 22, rough 38, or penalty areas 142, 146 the ball lands. For an exceptional strike, the system may determine that the ball even lands in the approach area 16, the green 14, or in rare occasions makes a hole in one in the cup 54. The sensor 158 may be a radar, launch monitor, or camera. The screen will generally show the hole 10, which may include all or some of: fairway landing area 22, rough 38, penalty areas 142, 146, approach area 16, the green 14, the cup 54. The screen 154 may be a computer screen, or a screen configured to receive projections from a projector. In some embodiments, the simulator building 26 may comprise a projector 162 configured to project onto the screen 154. A computer 166 may be in communication with the sensor 158, mat 150, screen 154, and projector 162. The simulator building may also comprise a second projector 170 configured to project onto the hinged exit door, sliding exit door or else onto a sliding screen situated in front of the exit door. These doors may be painted with projector paint or else be affixed with a hard or soft projector screen or screen material to improve the quality of the projected image. The a safety divider 174 or wall may be set up around the mat 150 to prevent onlookers from being hit by an errant ball or club. The simulator building 26 may have an entrance way 178, and an exit 182 to the hole 10. The entrance way 178 may be an overhead door. A curtain 186 may be located between the safety divider 174 and the walls 190 of the simulator building 26. There may be a second screen 156. The second projector may be configured to project onto the second screen 156.

Figure 6:
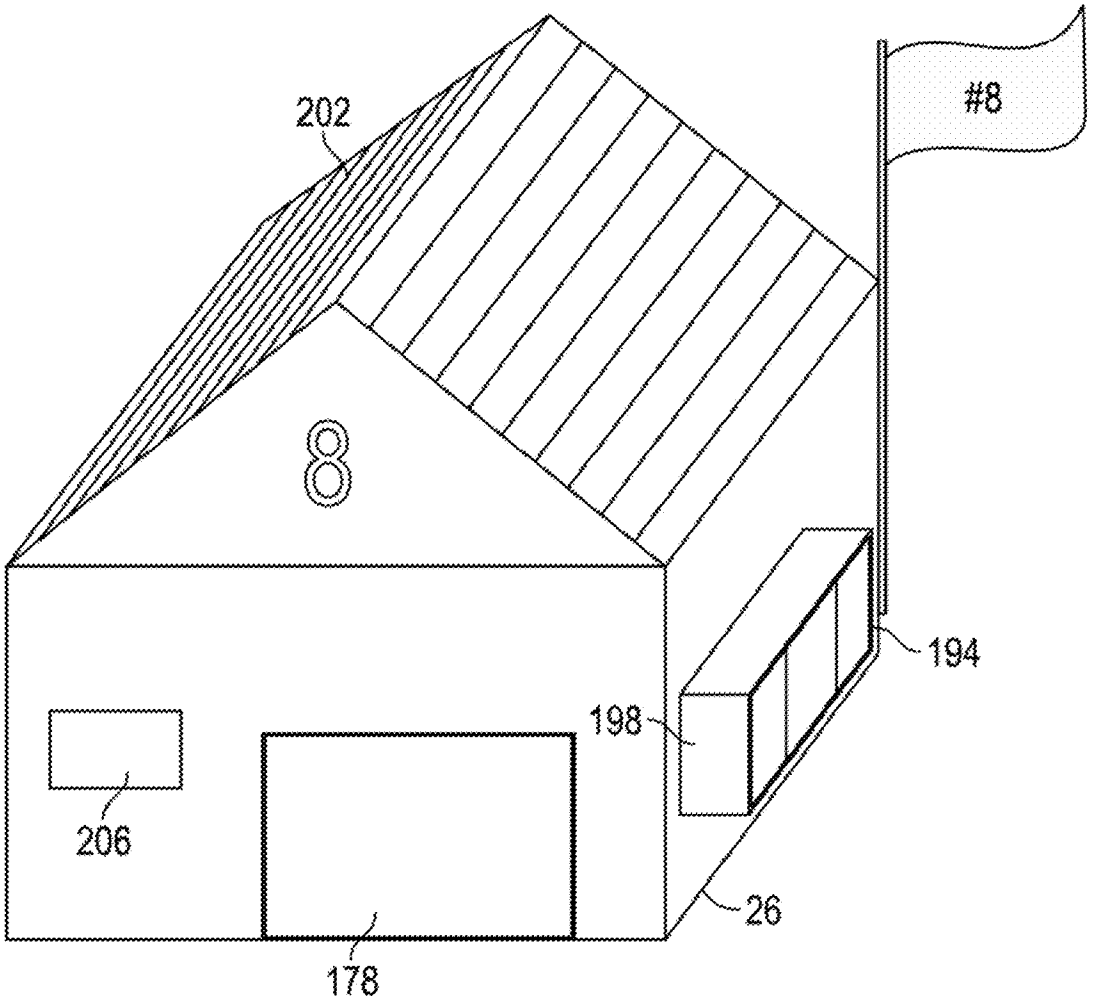
FIG. 6 is an perspective view of one embodiment of a simulator building.

FIG. 6 is perspective view of the outside of one embodiment of the simulator building 26. There may be food and drink 194 available for players as well as lockers 198 where food or drink is delivered to for golfers soon to arrive at the simulator building. The building 26 may have a roof 202. There may be a second computer 206 in communication with the first computer 166.

Figure 7:
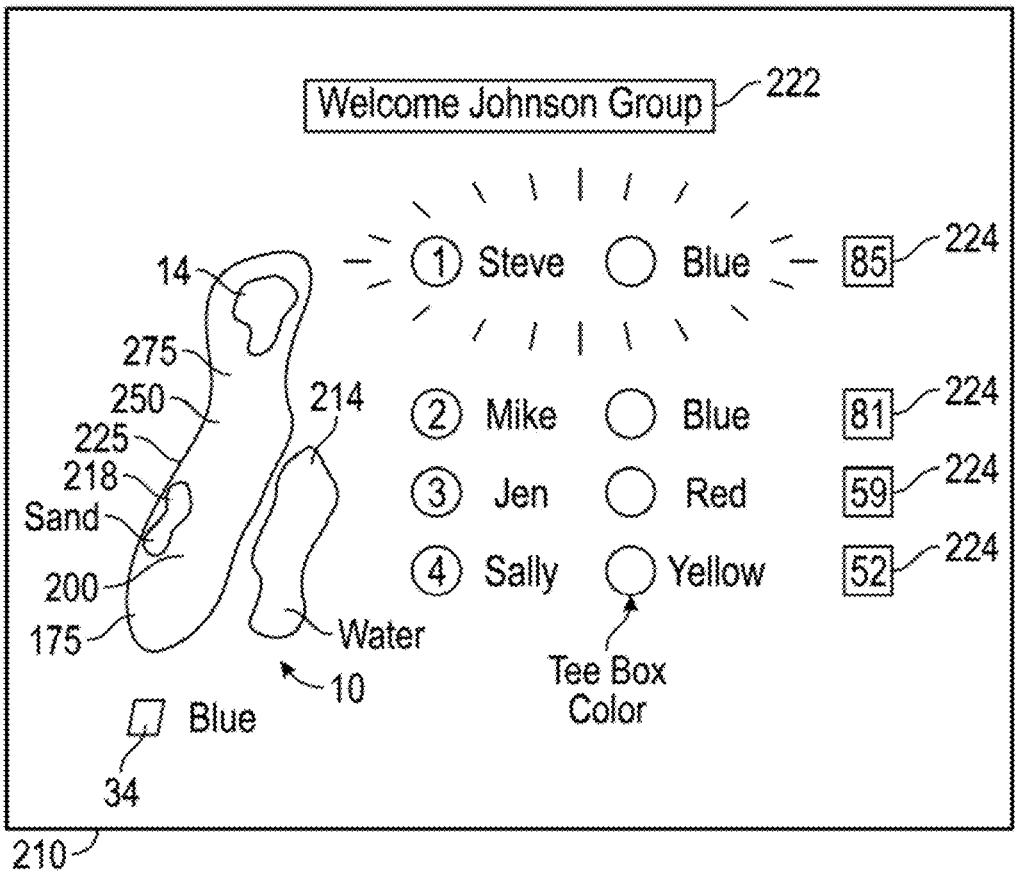
FIG. 7 is a screenshot of a simulator display.

FIG. 7 is one embodiment of a simulator display 210 upon entry into the simulator room 26. The simulator display 210 may be shown on the screen 154. In other embodiments, the simulator display 210 may be available on smart devices, such as smart phones, tablets, PC's, etc. The display 210 may show the hole 10, with any hazards, such as a water hazard 194 or sand hazard 198. The virtual tee box 34 is shown with distances to various points on the hole 10. The players' names are shown, and their associated color for their tee box and their Infinite Tee Rating if used. A welcome message 202 may also be shown. Adjacent to the associated color for their tee box may also be their Infinite Tee rating 224.

Figure 8:
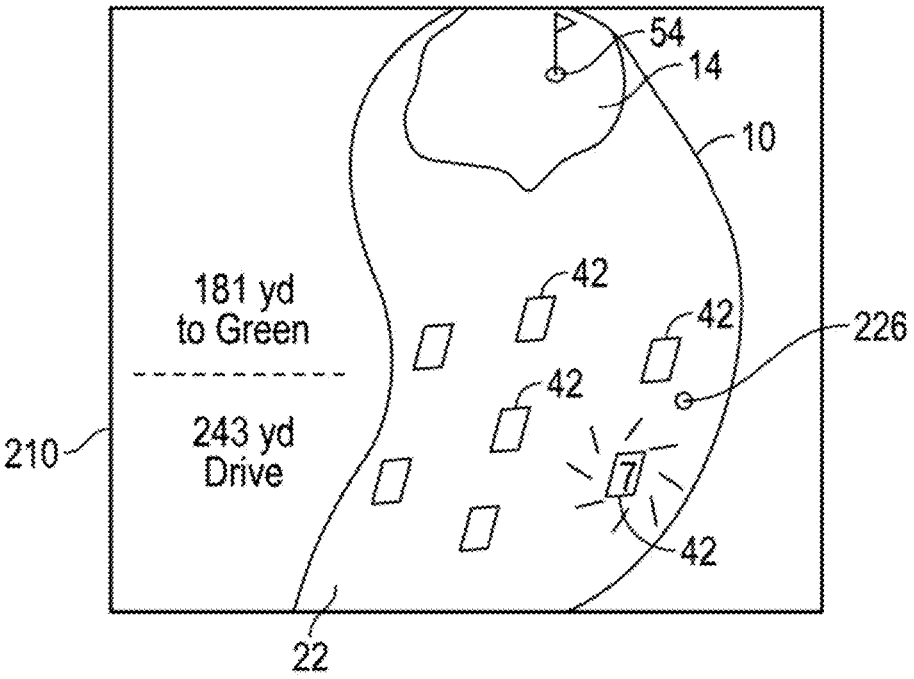
FIG. 8 is another screenshot of a simulator display.

FIG. 8 shows the simulator display 210, but now showing where a drive lands on the hole 10. The ball 226 is shown near mat 42, with number 7 on it. The mat 7 may flash in the display 210 or otherwise make clear that it is the mat closest to the ball 226. Other information about the drive may be shown on the display, including yards left to the green, and how long the drive was, in this case there is 181 yards to the green, and the drive was 243 yards. In one embodiment of the golf game system, the player may simply place the actual ball on the mat identified as 7 on the actual golf hole 10.

Figure 9:
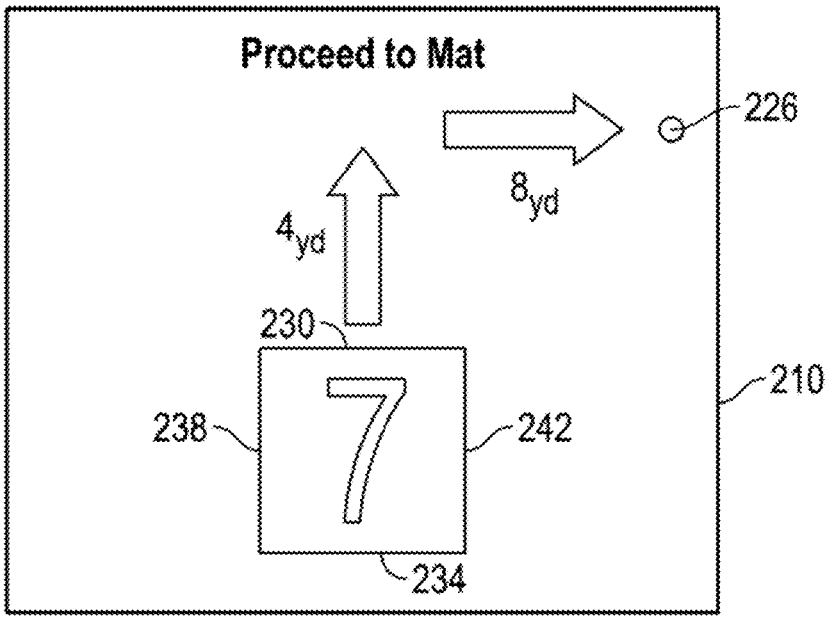
FIG. 9 is another screenshot of a simulator display.

FIG. 9 shows another embodiment of the simulator display 210, but in this embodiment, rather than placing the actual golf ball on the mat nearest to wear the drive in the simulator indicates, the display will give directions relative to the mat for a more exact location of the ball location after the drive in the simulator. The display 210 shows the directions relative to the mat 7 for the location of the ball 226. In this example, one moves up (up meaning relative to the upwards direction the number "7" is shown on the mat and in a direction pointing closer to the hole) 4 yards relative to the mat 7, and to the right 8 yards. In other words, the top 230 of the mat is adjacent to the top of the "7", so one moves 4 yards away from the top of the mat, and then to the right 8 yards. The bottom 234 of the mat is adjacent to the bottom of the "7", and the left side 238 of the mat is adjacent to the left side of the "7", and the right side 242 of the mat is adjacent to the right side of the "7".

Figure 10:
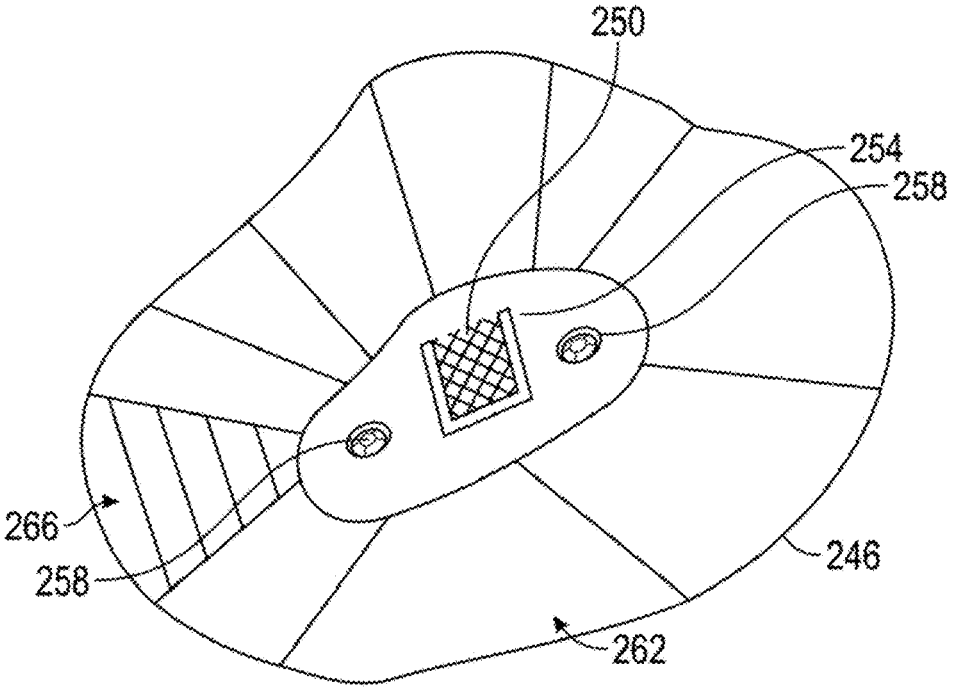
FIG. 10 is a schematic view of a composite bunker.

FIG. 10 shows one embodiment of a composite bunker 246 to be used on the actual real golf course. In order to save on costs, rather than having a full bunker as described in the official rules of golf, a composite bunker 246 may be used. The bunker 246 comprises sand shot area 250 surrounded by a boundary 254. The boundary may be made of a rubber material, or any other suitable physical material. In another embodiment, the boundary may be a clearly defined area recessed relative to the surrounding area. The recess may or may not have a boundary material different from its surroundings. The recess is to be a depth of 3 inches or greater to facilitate a golf club traveling through the sand and beneath the golf ball. Adjacent to the sand shot area 250 may be one or more drains 258. Surrounding the sand shot area 250 and drains 258 may be the sidewalls 262 of the composite bunker 246. The sidewalls may consist of artificial turf, netting, fabric, or any other suitable material. These sidewall are generally sloped to retain golf balls and direct them towards the bottom of the bunker. There may also be steps 266 leading down to the sand shot area.

Figure 11:
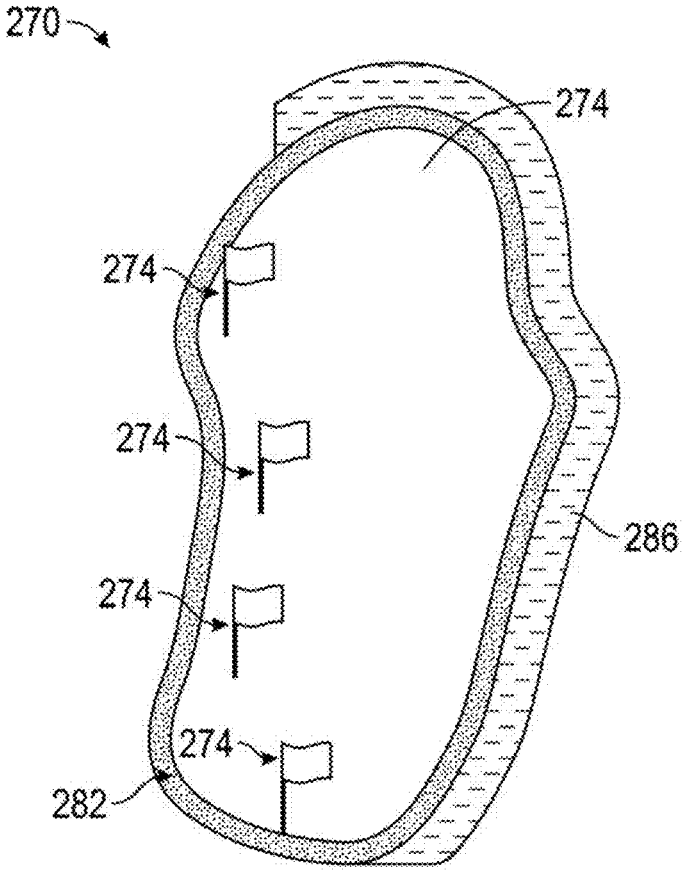
FIG. 11 is a schematic view of an alternative water hazard.

FIG. 11 shows one embodiment of an alternative water hazard 270. In this embodiment, there is a water hazard interior 274. The water hazard interior 274 may comprise artificial turf, alternate terrain, shallow water, painted grass, or standard golf course grass, or any other suitable material. There may be water marks 278 located throughout the water hazard interior 274. The water marks 278 may be flags, or other indicia showing the location of the water marks 278. The marks are used to allow for the simulator to accurately communicate a position at which the golf ball crossed the margin of the water hazard. The water hazard 274 will have a border 282. The border 282 may be made out of rocks, mulch, paint, rope, alternative terrain, or any other suitable material. The may be a low fence 286 bordering a portion of the alternative water hazard 270. The fencing 286 may have the word "WATER" printed, painted, or otherwise applied to the fencing. Using this alternative water hazard 270 can save cost and time in maintaining this type of water hazard.

Figure 12:
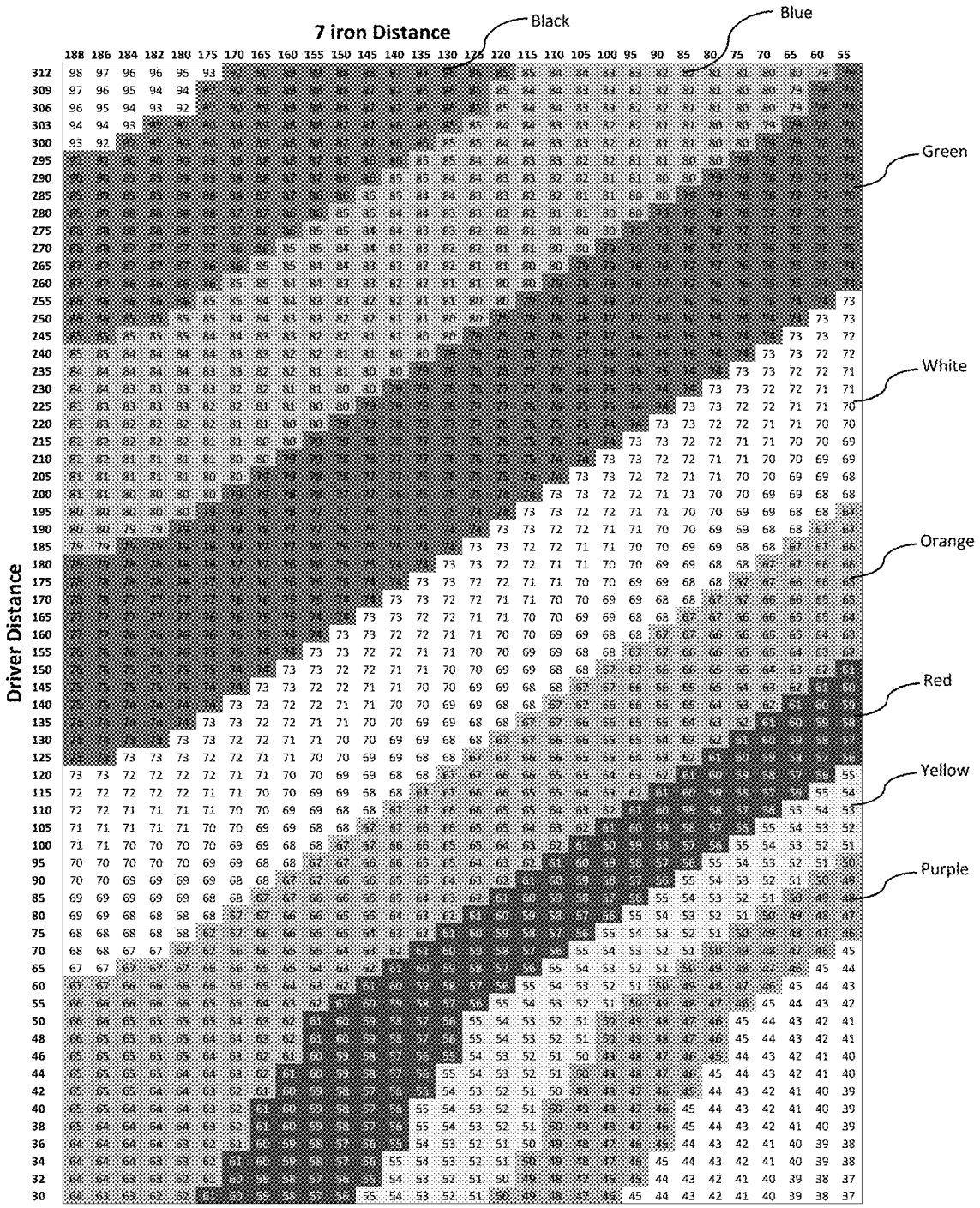
FIG. 12 is page 2 of an Infinite Tee X-Y look up table of data, showing various driver/7 iron distance combinations.
Figure 13:
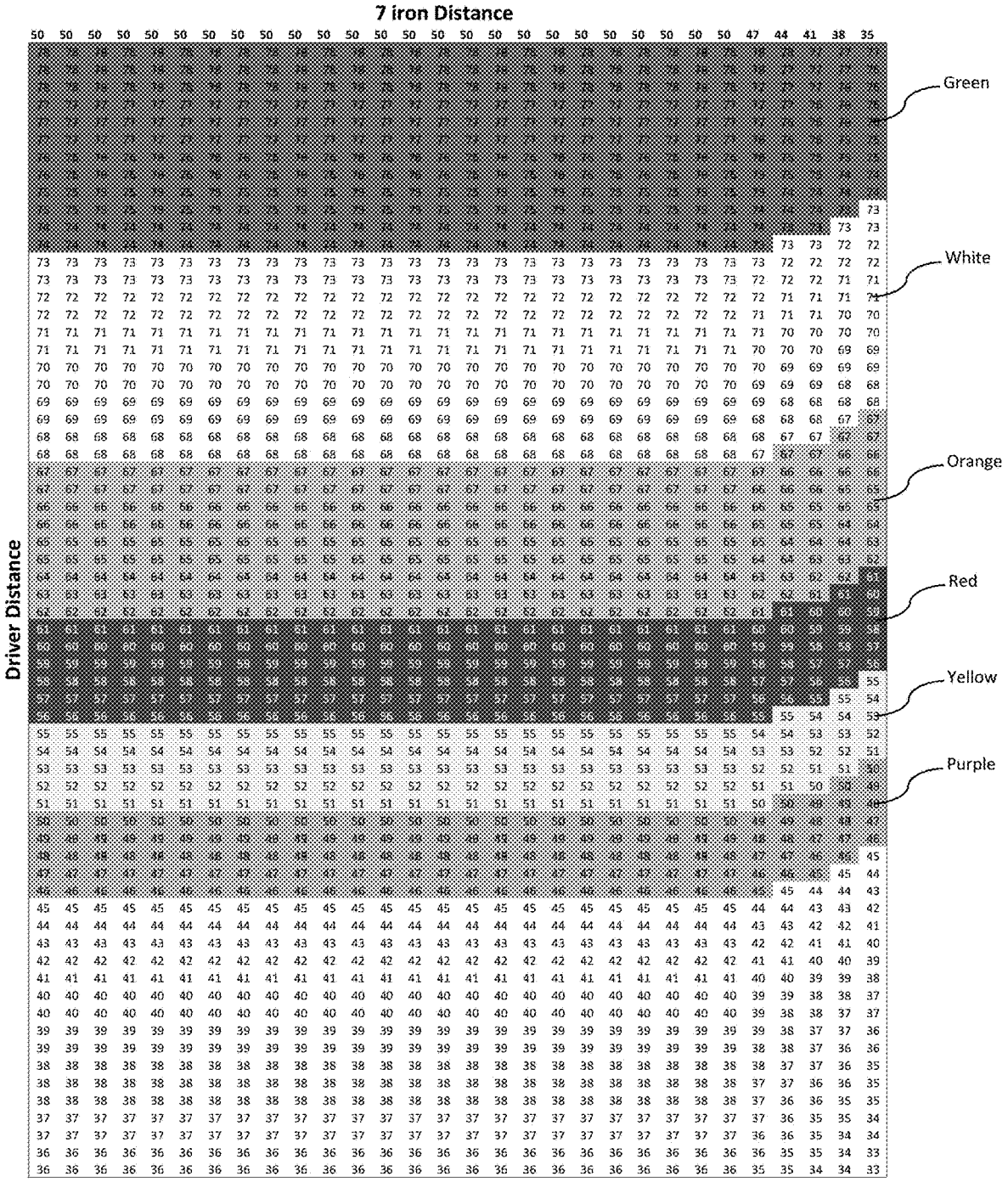
FIG. 13 is page 1 of an Infinite Tee X-Y look up table of data, showing various driver/7 iron distance combinations.

FIGS. 12-14 are tables of data to calculate the infinite tee ranking. A golfer will hit some quantity of shots into the golf simulator using their driver or longest distance club. Software will use launch monitor data from all or some subset of shots (example best 3 shots) taken for later computation. Additionally, the golfer will hit some quantity of shots into the simulator using their 7 iron. If golfer does not have a 7 iron, they can hit a combination of the next closest clubs (example 3 shots with 6 iron and 2 shots with 8 iron). Software will use launch monitor data from all or some subset of 7 iron shots (example best 3 shots) taken for computation alongside the data taken when hitting driver. In its simplest form, software may use the sum of average driver and average 7 iron distance to then calculate an Infinite Tee Rating. Additionally, the software may use supplemental information (achieved only through the use of a simulator/launch monitor) such as variation (average, median, range or standard deviation) of driver distance, 7 iron distance, club face angle, swing speed, smash factor, angle of attack, etc. This data will help to gauge consistency of the golfer's swing which is a factor in how much advantage a golfer may need in tee position. The rating scale graduations will correlate to very small graduations of tee box spacing (example 1 or 2 yards). For instance if a golfer hits a driver a distance of 295 yards and a 7 iron a distance of 180 yards, then on FIG. 12, the golfer will have an infinite tee rating of 90, and use the black tee boxes. In one embodiment, depending on the distances the golfer can hit, the infinite tee rating will suggest the player simply using the black, blue, green, white, orange, red, yellow, or purple or other defined tee location. In another embodiment, the software will allow golfer to play a tee location based on their exact Infinite Tee Rating. This exact position may reside in the same tee box as a defined tee position (example blue tees), however it may be some number of yards closer or further away than the defined tee position (example blue tees) depending on the Infinite Tee Rating and the graduations in yards between Infinite Tee Ratings. Choosing to use the Infinite Tee rating allows a golfer to play their round from a tee position matched perfectly to their skill level based on the Infinite Tee Rating.

FIG. 15 is a simplified table showing only a subset of driver/7 iron distances, the sum of these distances, and the corresponding Infinite Tee rating. Using this table could allow a golfer to quickly approximate their Infinite Tee rating without the use of the simulator and complex simulator data by simply adding what they know or estimate their driver and 7 iron distances to be. The simplified table of FIG. 15 shows how the sum of driver plus 7 iron distance might correlate to Infinite Tee rating.

When using Infinite Tee, the simulator software analyzes the player's swing based on either various information, such as, but not limited to: an estimate of players best 7 iron/driver distance, or analysis of actual golf ball and golf swing data such as variation (average, median, range or standard deviation) of driver distance, 7 iron distance, club face angle, swing speed, smash factor, angle of attack, etc. . . . on the golf simulator. The simulator software then assigns the player an Infinite Tee number rating, for example "83". The simulator software will then give the player two options on how to use that rating to compensate for the player's distance or lack thereof. The first option is: (1.) Play from an exact tee position that matches an Infinite Tee rating of 83 perfectly. The second option is: (2.) Play from a predefined tee box (like blue), but adjust the golfer's ball speed to perfectly match that tee position. This adjusted ball speed will get used to compute a slightly modified golf ball path that gets displayed on the simulator immediately after striking the tee shot. This allows two different skill player to play blue tees together.

Players who used the golf simulator to calculate their Infinite Tee rating will get one additional option to modify the golf ball path that gets displayed on the simulator immediately after striking the tee shot. They may choose to use a golf ball side spin reducer/golf swing path adjuster. Adjusting the two variables will have the effect of straightening the golf ball path. This option would primarily be used by low skill or beginning golfers to increase the probability of the golf ball landing in the landing area of the golf course. The golfer will select an on/off toggle for using this option or not. If selected the golfer will input a percentage of adjustment from 1 to 100%. Note: 100% will rarely be chosen as it would have the effect of the golf ball travelling in a perfectly straight path every tee shot.

In an embodiment, where the simulator software has the option of using side spin/swing path adjuster, and the player's infinite tee rating is 83, the options on how to play are below:

1. Play from an exact tee position that matches 83 perfectly. No side spin/swing path adjustment.
2. Play from an exact tee position that matches 83 perfectly. With side spin/swing path adjustment.
3. Play from a predefined tee box (like blue), but adjust the player's ball speed to perfectly match that tee position. This allows two different skill player to play blue tees together. No side spin/swing path adjustment.
4. Play from a predefined tee box (like blue), but adjust the player's ball speed to perfectly match that tee position. This allows two different skill player to play blue tees together. With side spin/swing path adjustment.
5. Play from a predefine tee box (like blue) but basically ignore the Infinite Tee recommendations.

See example below (of option item 4 from above) where both ball speed adjustment and side spin/swing path adjustment are being used and side spin/swing path reduction is set at 50%.

Figure 16:
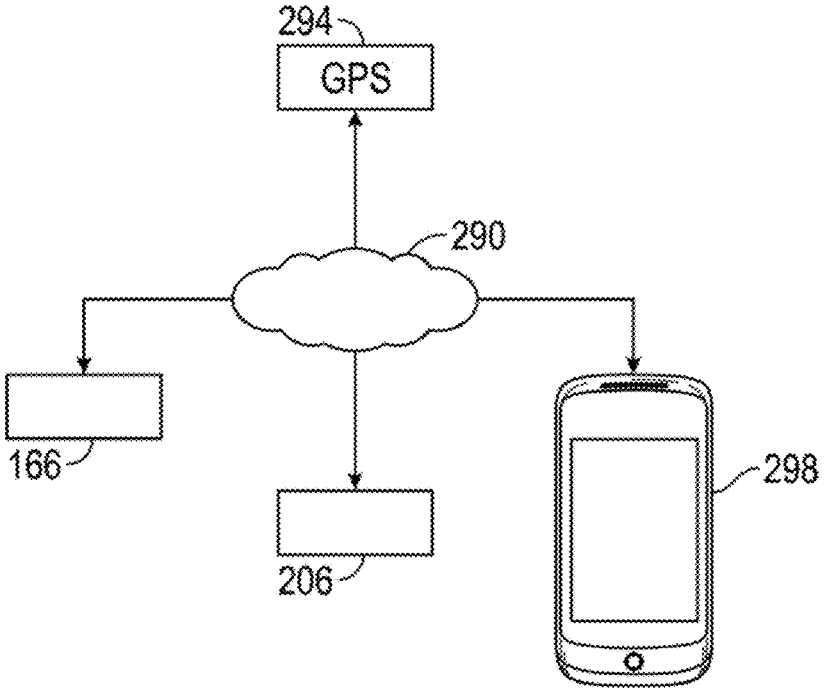
FIG. 16 is a schematic view of the golf game system.

Actual swing
Ball speed: 132 mph
Side spin: 900 rpm clockwise
Swing path: 3 deg from inside
Adjusted swing used on the simulator tee shot
Ball speed: 138 mph
Side Spin: 450 rpm clockwise
Swing Path: 1.5 deg from inside FIG. 16 is a schematic showing one embodiment of the disclosed system. A network 290 is shown. The network 290 may be or include the Internet, World Wide Web, a local area network, or some other public or private computer, cable, telephone, cellular telephone system, client/server, peer-to-peer, or communication network or intranet. In some embodiments, the communication network can also include other public and/or private wide area networks, local area networks, wireless networks, data communications networks, or connections, intranets, routers, satellite links, microwave links, cellular or telephone networks, radio links, fiber optic transmission lines, ISDN lines, T1 lines, DSL connections, etc. Computers 166 and 206 may be in signal communication with the network 290. Computer 166 may have the simulator software system installed on it. A global positioning satellite system 294 may be in signal communication with the network. A mobile computing device 298 may also be in signal communication with the network 290. The mobile computing device 298 may have a mobile software application ("app") installed on it related to the golf game system. The app may be implemented, executed, launched and used in the mobile computing device 298. Examples of such a mobile computing device include but are not limited to a tablet, a laptop computer, a personal digital assistant (PDA), a BLACKBERRY device developed by Research in Motion (RIM) of Waterloo, Ontario, Canada, an IPHONE device developed by Apple Computers Inc. of Cupertino, Calif., smart watch, and any other smartphone and cell phone as apparent to one skilled in the art. Throughout this patent application, numerous references may be made regarding servers, services, engines, modules, interfaces, portals, platforms, or other systems formed from computing devices. It should be appreciated that the use of such terms are deemed to represent one or more computing devices having at least one processor configured to or programmed to execute software instructions stored on a computer readable tangible, non-transitory medium. For example, a server can include one or more computers operating as a web server, database server, or other type of computer server in a manner to fulfill described roles, responsibilities, or functions. Within the context of this document, the disclosed smart phones, tablets, or hand held computers are also deemed to comprise computing devices having a processor and a non-transitory memory storing instructions executable by the processor that cause the device to control, manage, or otherwise manipulate the features of the disclosed apparatuses, systems and methods. The app may guide a player to where his or her ball is to be placed on the actual golf course. The app may also guide a player to which mat his or her ball is to be placed on, on the actual golf course.

Figure 17:
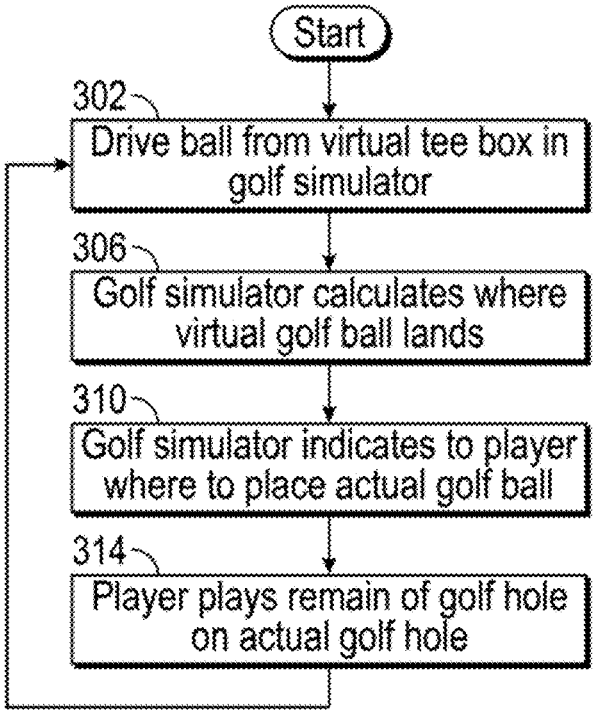
FIG. 17 is a flowchart of the system.

FIG. 17 is a flowchart representing one embodiment of the golf game system. At act 302, a player hits a drive with his or her golf club at a virtual tee box in a golf simulator system. At act 306, the golf simulator system calculates where the ball lands on the fairway landing area or rough landing area. At act 310, the golf simulator system indicates to the player where to place an actual golf ball on the actual golf course. In one embodiment, the golf simulator system will indicate which mat located on the fairway landing area or rough landing area, to place the ball. In another embodiment, the golf simulator system will indicate in which direction and distance from a particular mat to place the ball. At act 314, the player plays the remainder of the shortened golf hole on the actual golf hole.

Figure 18:
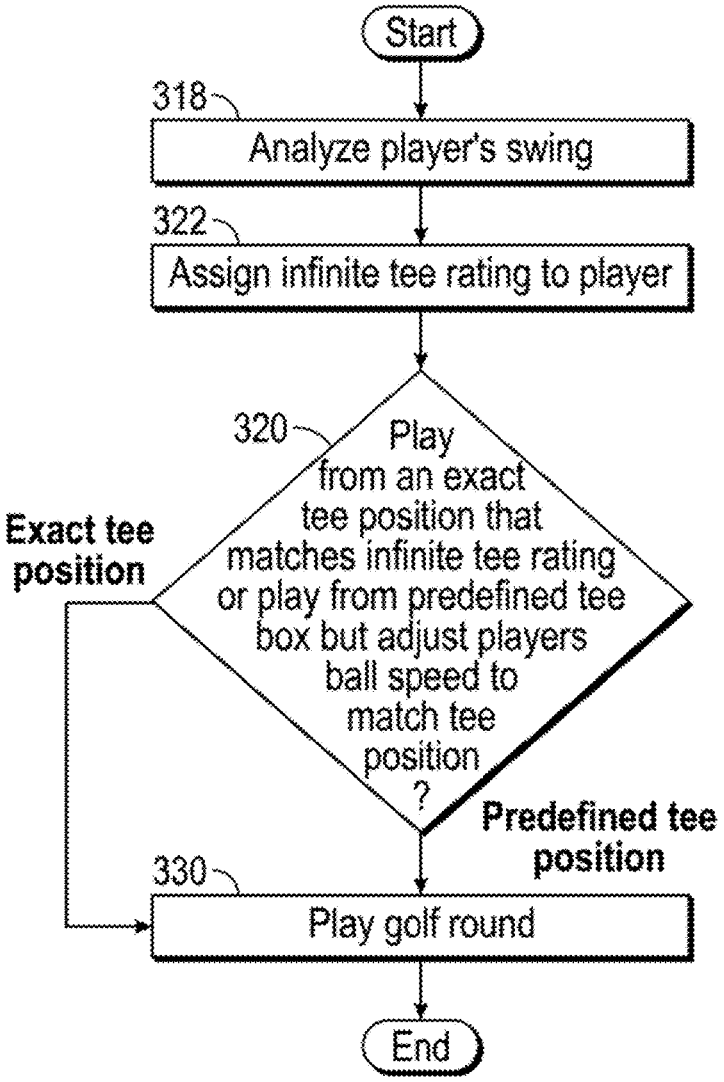
FIG. 18 is a flowchart showing one embodiment of the golf simulator process.

FIG. 18 is a flow chart showing one embodiment of the golf simulator method. At act 318 the golf simulator analyzes the players swing. The analysis may be based on various information, such as, but not limited to: an estimate of players best 7 iron/driver distance, or analysis of actual golf ball and golf swing data such as variation (average, median, range or standard deviation) of driver distance, 7 iron distance, club face angle, swing speed, smash factor, angle of attack, etc. . . . on the golf simulator. At act 322, the golf simulator assigns an infinite tee rating to the player. At query 326 the player can select from two options. The first option is that that the player may play from an exact tee position that matches an Infinite Tee rating of 83 perfectly, and the second option is that the player can elect to play from a predefined tee box (like blue), but adjust the golfer's ball speed to perfectly match that tee position. This adjusted ball speed will get used to compute a slightly modified golf ball path that gets displayed on the simulator immediately after striking the tee shot. This allows two different skill players to play blue tees together. At act 330, the player plays the golf round.

Figure 19:
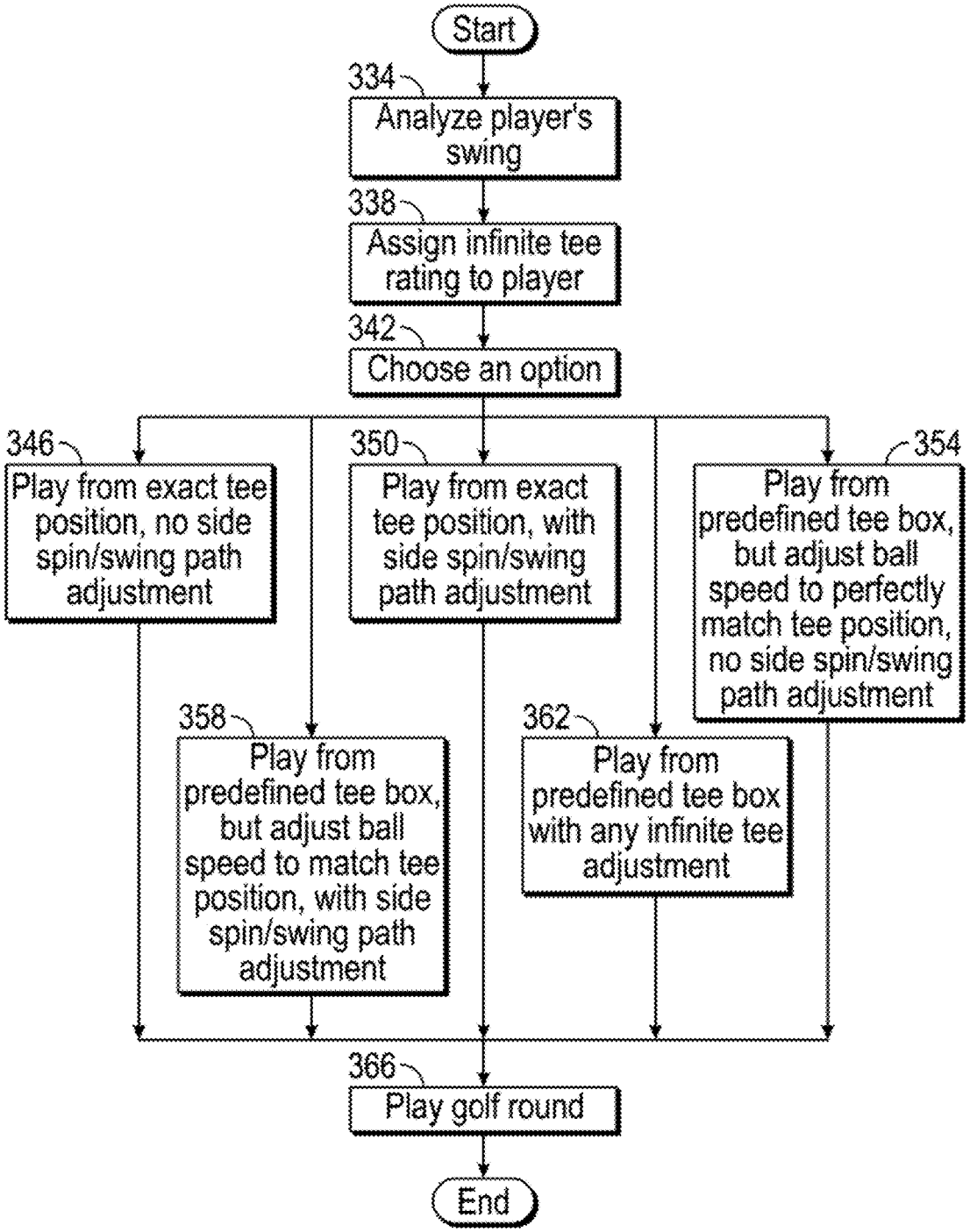
FIG. 19 is a flowchart showing another embodiment of the golf simulator process.

FIG. 19 is a flow chart showing another embodiment of the golf simulator method. At act 334 the golf simulator analyzes the players swing. The analysis may be based on various information, such as, but not limited to: an estimate of players best 7 iron/driver distance, or analysis of actual golf ball and golf swing data such as variation (average, median, range or standard deviation) of driver distance, 7 iron distance, club face angle, swing speed, smash factor, angle of attack, etc. . . . on the golf simulator. At act 338, the golf simulator assigns an infinite tee rating to the player.

At input 342, the player chooses one of the five acts (346 to 362). At act 346, the player elects to play from an exact tee position that matches 83 perfectly with no side spin/swing path adjustment. At act 350, the player elects to play from an exact tee position that matches 83 perfectly, and with side spin/swing path adjustment. At act 354, the player elects to play from a predefined tee box (like blue), but adjusts the player's ball speed to perfectly match that tee position. This allows two different skill players to play blue tees together. This act has no side spin/swing path adjustment. At act 358 the player elects to play from a predefined tee box (like blue), but adjust the player's ball speed to perfectly match that tee position. This allows two different skill players to play blue tees together. This act has side spin/swing path adjustment. At act 362, the player elects to play from a predefine tee box (like blue) but basically ignore the Infinite Tee recommendations.

Using the disclosed golf game system, an area of land, approximately 50% smaller than land used on traditional golf courses, may be used to create a 9 or 18 hole round of golf requiring the full array of golf clubs, golf shot distances, golf course total distances, and skill required on any traditional course. This may be achieved with a connected series of golf simulators spaced on various holes across the physical golf course. The golf simulators may be located in the tee shot Landing Area of par 4 and par 5 golf holes or in the tee box area of a par 3 golf hole. Alternatively on par 3 holes, the hole may be played without the simulator as the land savings on a par 3 is less substantial.

Golfers may start play inside a simulator building. Inside the building (or from outside the building), the golfer can interact with the software by selecting such information as golf group name/ID, golfer name and the tee box type (ex. red tees, white tees, blue tees etc.) from which each golfer will hit their tee shot. Some of the information above will only have to entered in the first Simulator Building as the software will save the information and will track completion of one golf group's tee shot and commencement of the next golf group's tee shot. Alternatively, the majority of information pertaining to a golfer or golf group can be inputted into the software by Golf Course Clerk/Staff upon check in and payment for the round of golf. If agreeable, golfer information can be saved by the software for future rounds and/or for evaluation of tee shot statistics by the golfer or a golf instructor.

The tee type chosen can precisely match the golfer skill level and/or desired challenge. This benefit is simply achieved by having a much greater quantity of standard tee boxes to choose from compared to a traditional golf course. For example 8 or more (purple, yellow, red, orange, white, green, blue, black) choices compared to 3-4 (red, white, blue and possibly black). To obtain an even more precise tee type match, golfers will use the Infinite Tees program prior to selecting tee type. See Infinite Tees section 5D below for more details on how the simulator allows golfers to use a tee that precisely matches their skill level.

Upon completion of the tee shot into the simulator screen, the software will provide the identification of a specific golf mat or marker from where the golfer may take their next shot on the physical golf course. Additionally, the software will provide an exact golf ball location in the form of a simple distance to travel from the nearest golf mat in two directions (forwards/backwards and left/right). If desired, the golfer may choose to place or drop their golf ball in this precise location in lieu of using the mat.

The 2nd shot is taken from the golf mat or precise location as described above and golf is subsequently played on the physical golf course for the remainder of the hole. The 2nd shot being taken from a mat purposely has the intent of being a segue between the tee shot and the remainder of the golf shots as can be seen below. Tee shots are hit off of a mat and are played indoors (simulator building). Second shots are hit off of a mat (or grass if a precise location is decided to be used in lieu of the mat) and are played outdoors (physical golf course). Remaining shots are hit off natural grass and are played outdoors (physical go if course).

Golfers may enter the simulator building typically from the back side of the building through a large garage or barn style door. This large opening will give ample air flow and will also minimize the sounds that the golfers may hear from the impact of golf club to golf ball. Remaining interior walls of the building may be covered with sound dampening/absorbing materials to further reduce sounds that the golfers will hear. The hitting area of the building may be blocked off with fencing, netting or half walls to keep observing golfers away from the golfer hitting their tee shot. Signage may exist to clearly communicate to the golfer how to enter the hitting area and how to exit the building.

Simulator equipment may include golf mats, golf tees, simulator screen and protective netting. Golf monitors should be located in the ceiling or behind the golfer to avoid any adjustments by the golfers to accommodate both right and left handed golfers. Adjustments by the golfer could cause the simulator to not work properly and would cause added time to make adjustments which would add time to the round of golf.

Golfers may exit the Golf Simulator typically from the front side of the building adjacent to the simulator screen. The image on the simulator screen upon exit will precisely match the view of the physical golf course that the golfers will see upon exit from the building. This will give a sensation of seamlessly transitioning from the virtual to physical golf course.

Alternatively, a second projector may project the image of the golf course directly onto a hinged exit door, sliding exit door or else onto a sliding screen situated in front of the exit door. These doors may be painted with projector paint or else be affixed with a hard or soft projector screen or screen material to improve the quality of the projected image. Having this second image will further enhance the sensation of transitioning from the virtual to physical golf course. When using sliding doors or sliding screen, sensors should be used to automatically slide open the door or screen to maintain the optimal focal distance for viewing the image and to avoid shadows on the image. An alternative to using a projected image could be simply a static image painted or printed onto the door, surrounding area or affixed to a sliding screen/vertical surface.1

Inside the simulator building may be a designated area for golfers to interface with the simulator software and select information such as order of play (which golfer will hit first, second, third and fourth), to select or change tee box type, and to communicate with Golf Course Staff. This software will include functionality to order food or drinks that can be delivered to subsequent simulator buildings.

An additional interface may be available in a covered area on an outside wall of the simulator building so one golf group can be inputting information, while the group ahead of them is inside the Simulator Building hitting their tee shots.

Certain simulator buildings may be equipped with lockers where food and drink can be delivered to the golfers. Accurate monitoring of golf group locations allows for accurate delivery timing to a simulator building of the golfers preferred timing. Golfers may purchase food/drink upon check in and arrange for delivery to various simulator buildings during the round. Golfers may be given a key or code upon order to prevent tampering with their order. Certain lockers may be designated and constructed specifically for hot food or for cold drinks.

Golf simulator programming may be used to transfer information about the golf swing to accurately calculate and display the flight path of the golf ball relative to the golf hole images projected onto the simulator screen.

The simulation software can accurately map and display on the screen the following segments of the golf hole: The Virtual Only portion of the golf hole between the tee box and the landing area; the Physical Landing Area of the golf hole which includes the Simulator Building and the $2^{nd}$ Shot Mats; The Physical Approach Area & Green (including surrounding area beside and beyond the green). The simulator software, through the use of a code given to the golfer or signal from the Golf Clerk located in the ProShop or CheckIn Area, will only begin after groups have checked in and paid for their rounds of golf.

The simulator software may precisely track golf group location and pace of play since play for each hole commences at the simulator building exact timing of tees shots is known. A golf clerk can communicate with each golf group via the software and simulator screen.

Prior to the first golfer hitting their tee shots, the simulator software may display the full golf hole on the screen and will show precise distances from the tee box chosen to a plurality of locations on the golf hole, typically in 25 yard increments. These locations will show both distance from tee alongside distance remaining to the center of the green. If all golfers are playing from the same tee box, this information will not be shown again. If other golfers are playing from other tee boxes, the information, with new distances, will be shown just prior to the other golfer's tee shot.

The simulator software may allow the golfer to adjust the angular position of the virtual fairway relative to the golfer.

Standard angular position will have the golfer facing in a direction that aims the golfer to the safest landing spot from the Tee Box being played.

A golfer may then adjust angular position to a number of preset angles (for example 2 clockwise and 2 counter clockwise in addition to the standard position. The simulator software may display corresponding carry distances for each of the angular positions. Any further deviation from these preset angles can be achieved by the golfer hitting different spots (off center from the middle of the simulator screen) which creates further offset angle from the preset angle.

After the golfer has hit their simulated tee shot and the landing spot is displayed on the screen, the software may then overlay images showing all of the mat (or marker) and simulator building locations in the view shown on the simulator screen. If required, the view may zoom out to a point where all mats (or markers) and the simulator building can be seen on the display. The mat where the golfer is to go to for their 2nd shot may become clearly identified (blinking, enlarged, change in color, etc.) for the golfer to begin to consider their next shot and also to provide orientation of the golf mat relative to the simulator building.

The simulator software may allocate areas (zones) of the landing area, that when the simulated tee shot lands on, will give instructions to the user to proceed to locations on the physical course with the below considerations. When using mats, software may give slight yardage increase (advantage) when simulated drive lands in fairway and may give slight yardage decrease (disadvantage) when drive lands outside of fairway depending on location of drive compared to nearby mat locations. In addition to identifying the nearest golf mat, the simulator software will provide precise distance and direction from the mat to the spot in the landing area of the physical golf course where the simulated tee shot would have come to rest. This location will be provided as a distance (forwards/backwards and left/right) from a $2^{nd}$ shot golf mat or marker. The golfer will then have the choice of hitting their next shot from the mat or the precise position depending on preference.

Golfers may proceed to the physical golf course immediately following their shot (to further increase the pace of play) or may choose to wait until all golfers in the group have hit.

Mats located on the physical fairway will be of the highest quality allowing for a high quality strike of the golf ball including appropriate amount of cushion to allow hitting down on the golf ball for optimum ball flight.

Alternatively, mats located to the left or right off the fairway may be of lesser quality and may be either harder (less cushion) or be made with significantly longer synthetic grass. Both of these conditions will limit the type of shots (trajectory, spin, etc.) that can be played from those mats.

Mats may be clearly identified with letters and/or numbers that match the letters and/or numbers displayed on the simulator.

A numbering convention will be used where tee shots that land in the following areas will be identified consistently from hole to hole. In various embodiments, the convention may that the center of fairway is identified with even numbers; left or right side of fairway identified with odd numbers; left of fairway identified with letters starting with the letter "L"; right of fairway identified with letters starting with the letter "R". An alternative to the mat/marker is the use of an app integrated with the software that will take the golfer to an exact location via cell phone GPS (or other GPS capable device) to drop their ball.

Upon completion of a golfer or golf group's drive into the simulator, information regarding ball position will be transmitted via Bluetooth (or other wireless interconnection type) from the simulator software to the golfer's cell phone (or other GPS capable device).

A marker (dot or other symbol) on the app will identify the ball position and a different marker (dot or other symbol) on the app will identify the golfer. The software will alert with audible beep or vibration that the golfer has reached the ball position.

The simulator software will allow golfers to choose the Infinite Tees (tee selector) option from either the first tee simulator building or any simulator building on the course. A golfer will hit some quantity of shots into the simulator (example 5) using their driver or longest distance club. Software will use launch monitor data from all or some subset of shots (example best 3 shots) taken for later computation. Additionally, the golfer will hit some quantity of shots into the simulator (example 5) using their 7 iron. If golfer does not have a 7 iron, they can hit a combination of the next closest clubs (example 3 shots with 6 iron and 2 shots with 8 iron). Software will use launch monitor data from all or some subset of 7 iron shots (example best 3 shots) taken for computation alongside the data taken when hitting driver.

In its simplest form, software will use the sum of average driver and average 7 iron distance to then calculate an Infinite Tee Rating. The rating scale graduations will correlate to very small graduations of tee box spacing (example 1 or 2 yards). Alternatively, for an even more accurate calculation, the software can use additional or other launch monitor data as part of the Infinite Tee calculation. This calculation might include, for example, variation (average, median, range or standard deviation) of driver distance, 7 iron distance, club face angle, swing speed, smash factor, angle of attack, etc. . . . . This data will help to gauge consistency of the golfer's swing which is a factor in how much advantage a golfer may need in tee position.

Alternatively, the simulator software may ask the golfer to rate their short game (chipping, putting, short iron play) which is also a factor in how much advantage a golfer may need in tee position.

Based on the Infinite Tee Rating, software will give up to three options to the golfer for tee box positions to use for their upcoming or future rounds of golf.

Ratings falling within a certain range will result in software recommending to the golfer to play from one of a number of standard tee boxes. (for example purple, yellow, red, orange, white, green, blue, black).

Because these tee boxes exist only in the virtual section of the golf course, the tee boxes located closest to the green cannot interfere with the play of golfers hitting from the furthest tee boxes. For this reason, virtual tee boxes can be placed directly on the virtual fairway regardless of how close the tee box may be to the green. The closest tee boxes may be hidden from display by the software when golfers are hitting tee shots from the furthest tee boxes.

The simulator software will allow golfer to play a non-standard tee box position based on their exact Infinite Tee Rating. A golfer would play their round from a tee box position matched perfectly based on the Infinite Tee Rating. This position may reside in the same tee box as a standard tee position (example blue tees), however it may be some number of yards closer or further away than the defined tee position (example blue tees) depending on the Infinite Tee Rating and the graduations in yards between Infinite Tee Ratings. These exact graduations may vary from hole to hole depending on hole design, however an Infinite Tee Rating, for example 80 will always be some number of yards closer to the hole than for example 85.

Alternatively, the golfer may choose to play from a standard tee box such as the blue tees. This may be desirable if all members of a group all want to play the exact same tee box and see the exact same simulator view from the tee box. Instead of giving the golfer a distance advantage (closer tee box), the software can instead add extra speed to the virtual golf ball at launch resulting in the golf ball travelling an extra distance equal to the tee box distance advantage that would have been given.

Golfers playing together or against each other are more precisely matched when hitting from precisely the same tee box compared to golfers playing from different tee boxes. This is due to the additional side to side error that the golfer hitting from the further tees will experience (also called cosine error) compared to a tee shot hit from a closer tee box when the ball is hit with an identical swing plane and club face angle.

Water hazards found in the landing area of the golf hole will be simple roped off areas or else well-defined areas of unique terrain (differing from the surrounding terrain) such as rock, mulch, artificial turf or netting/fabric and identified as "Water Hazard". These areas represent exactly the boundaries of water hazards depicted by the simulation software. A golfer who hits a ball into the water hazard on the simulator tee shot will receive instructions from the simulator such as to "Add one stroke to your score and drop ball (put into play) in a specified location". The location may be provided as a distance (forwards/backwards and left/right) from a $2^{nd}$ shot golf mat or marker or else from other markers (referred to as Watermarks, possible future trademark) used specifically for locating the golf ball's point of entry to the water hazard. When playing the next shot after landing in a "Water Hazard", the golfer may be hitting off of natural grass and not off of a mat.

Similar imitation/representation or simple boundary of a water hazards may also be incorporated into the physical approach or green area of the golf course. The fact the hazard is not real water will allow for the golfer to quickly and easily retrieve their golf ball which would be underwater in a traditional water hazard. Because the hazard may not be real water, the ball might roll or bounce when hit into this hazard. To keep the ball in the hazard, a low fence or low netting will be added along the far side of the hazard boundary. Additionally water may be used in part or for the entirety of the water hazard depending on availability of water on the course. Traditional ponds, streams, rivers and lakes (as seen on the simulator screen) can be replaced with more simple shallow water pools where golf balls can be easily spotted and retrieved.

Any sand bunker in the landing area (also called fairway bunker) as portrayed in the simulator can be replicated in the physical landing area with a miniature sand bunker. This miniature bunker does not have to replicate the shape and depth of the simulated bunker. It merely has to contain sufficient area and depth of sand to hit an unobstructed golf swing from. If a simulated tee shot is hit into a fairway bunker the golfer will proceed to the miniature sand bunker on the physical course and place their golf ball in any location of the bunker that can facilitate an unobstructed golf swing. Greenside bunkers of the type normally used on traditional golf courses can be replaced with composite bunkers where the sidewalls are made using netting, artificial turf, rubber, fabric or any material (other than sand) that can facilitate collection of golf balls hit within the boundary of the bunker. A portion of the sand bunker may contain high quality sand or synthetic material that replicates high quality sand. The amount of sand used in this type of bunker is a small fraction of the amount used in a traditional sand bunker. The sand will be contained on at least 3 sides with rubber, other border material or else recessed into the bottom of the bunker to minimize required amount of sand, prevent unnecessary spreading/thinning of the sand and to help provide a consistent depth of sand to hit from. Additionally the bunker may have drains at the bottom to quickly evacuate any water that might normally collect at the bottom of the bunker. The sidewalls of the bunker may be contoured to help direct water towards the drains. Upon entry into this bunker, the golfer is allowed to place their golf ball onto any spot in the sand that can facilitate an unobstructed golf swing.

Upon completion of their last tee shot, the simulator display will take the golf group on a virtual "ride" from the tee box to the simulator building. This will give the golfer the experience of seeing the course and enjoying the trip to the landing area. This is intended to be fun and add an element of entertainment. This ride can be an aerial, giving the sensation of flying. The trip will end with the golfer being virtually transported to the inside of the simulator building resulting in a nexus between the virtual world and the physical world. The final display on the screen will match the view of the golf hole/course that golfers will see upon exit from the simulator building.

An extra golf hole (hole 10 on a 9 hole course, or hole 19 on an 18 hole course) can be created using the elements/embodiments of this invention (a simulator/simulator software/mats etc.) in order to further speed up pace of play on any golf course (traditional golf course or one using the elements/embodiments of this invention across the entire course). This extra hole is to be a combination virtual/physical hole that could be played as a replacement par 3, par 4, or par 5 for any hole skipped during regular play. A par 5 can be achieved either by having the player hit their $1^{4}$ and $2^{nd}$ shot into the simulator or else by having more mats or more mat spacing to allow for the par 5 drives to land further away from the hole than par 4 drives. A par 3 is generally achieved by using mats in the landing area of the hole as tee boxes. Par 3 tee shots can be hit from the simulator, but would require mats or markers in the approach area of the hole and possibly on the green itself. Neither of these is desirable, as the mats or markers could interfere with the play of people playing the hole as a par 4 or 5. Encouraging skipping of holes speeds up the pace of play for all golf groups behind the slower group that has fallen behind the group in front of them. Holes ahead of a golf group that are not occupied should be skipped but rarely are because golfers desire to play a full 9 or 18 holes of golf to be able to calculate a full 9 or 18 hole score and because they paid a high price to play a full 9 or 18 hole round of golf.

An 18 hole golf course can be created using the exact same or very similar amount of land required of a 9 hole course using only 9 greens in conjunction with changing the simulated fairway or adding characteristics the virtual fairway to affect how the hole plays. For example, hole #1 could be a par 4 "dogleg right" hole. Hole #10 could be a par 4 "dogleg left" hole. This may be achieved by having two different simulated/virtual fairways and using the same landing area, mats and green. Hole #2 could be a par 4 hole with a safe landing area allowing for golfers to hit their longest hitting club. Hole #11 could be a par 4 that has a simulated large body of water that splits the simulated/virtual fairway into two sections. This large body of water is located a distance from the tee that might force the golfer to use a shorter hitting club for their tee shot to land short of the water. This may be achieved by having two different simulated fairways and using the same landing area, mats and green. The landing area and quantity of mats might have to be larger to accommodate both ways of playing the hole. Hole #3 could be a par 4 hole. Hole #12 could be a par 5 hole with a much longer simulated/virtual fairway. This may be achieved by having two different simulated fairways and using the same landing area, mats and green. For the par 5 hole, the golfer will hit both their first and second shots from the simulator. Hole #4 could be a par 4 hole. Hole #13 could be a par 3 hole. This may be achieved by not requiring the golfer to hit a tee shot from the simulator on Hole #13. Instead the golfer will hit their tee shot from one of the mats used in the Landing Area of Hole #4 or else a different set of mats used specifically as "tee boxes" for Hole #13. These "tee boxes" might face the green from a much different angle than the mats used on Hole #4 creating a different challenge. Alternatively, if desired, a second physical green could be located near or attached "double green" to the first green allowing for one hole to be played to one green and one hole to be played to the other green. Furthermore, if desired, the simulator might have a virtual fairway on one hole that approaches a green from a completely different direction when playing a different hole. This may require a second landing area and mats or else might share the landing area and mats with some other hole. This could also be achieved by using a simulator, landing area and mats normally played to a different green. For example, Simulator, Landing Area and mats used on Hole #1 could be used to play to the green normally used on Hole #3.

The golf course may easily be set up to accommodate night golf due to the reasons stated above and especially because the tee shot is hit from inside the simulator building which is lighted and also ensures the golfer will not lose his or her ball. Also because electric power is being supplied to the various simulator buildings, it is easy to add lighting to the landing area of the physical golf course which will help with golf, but also help golfers safely get to and from the various simulator buildings. Stadium style light posts and/or lower level lights and/or in-ground lights can be constructed in the area of the green and approach area allowing golfers to see well enough to chip and putt.

Traditional golf simulation provides only a limited alternative to playing golf on a physical golf course. An increase in golf simulator use on its own will result in a net decrease in golf played on physical courses.

The disclosed golf game system has many advantages. For example replacing the traditional tee shot with a simulated tee shot provides benefits below: Eliminates time spent looking for lost golf balls from the tee shot which is where most balls are lost; Tee shots from simulator cannot be lost, this avoids time lost and also the cost of the lost ball; eliminates time spent travelling from the tee box to the landing area; reduces the need to use golf carts to get around a large physical course and in particular from tee box to the landing area on par 4 and par 5 holes. Note: the majority of land used is between the tee box and the landing area. Significantly reduces the amount of land needed and length of time required to play par 4 and par 5 golf holes. The length of a par 4 hole can be reduced to roughly 175 yds. from roughly 430 yards. The length of a par 5 hole can be reduced to roughly 250 yards from roughly 550 yards. Significantly reduces the amount of water, chemicals, fertilizer, labor, equipment to maintain the area between the tee box and landing area. Hitting tee shots from simulator allows all players in a group to hit from the same place which saves time and also allows golfers to choose the exact tee location that matches their skill level. Simulator software can off players an almost unlimited amount of tee positions too choose from to precisely match their skill level. A physical course is limited by physical space, terrain and maintenance budget to maintain only a limited selection of tee boxes. To save additional time, golfers can immediately proceed to the landing area to hit their next shot while the remainder of the golf group is still hitting tee shots in the simulator. Using golf mats and longer grass in the fairway landing area for hitting the $2^{nd}$ shot instead of manicured fairways eliminates: Water, chemicals, fertilizer, labor, equipment to maintain the landing area. Mats offer perfect conditions to hit golf balls from. Amateurs do not need the added difficulty of hitting from bad lies. Grass in the landing areas around the golf mats can be longer and kept natural allowing to brown out during dry periods. Integrating a golf simulator with a traditional golf course adds a modern digital element to the game which is attractive to young people. 50% smaller golf courses cost significantly less money to purchase and maintain which brings down the price golf courses must charge. The disclosed golf game system allows for 18 holes of golf to be played on a course with only 9 holes/9 greens. In this instance a golf course can be 75% smaller. 50% faster golf rounds allow for shorter spans of time between tee times and allows for more golfers to play the course per day which brings down the price golf courses must charge. 50% faster golf rounds reduces the amount of time that a golfer is exposed to inclement weather making golf in inclement weather much more tolerable. Having simulator buildings on most holes allows golfers a repeated respite from the inclement or dangerous weather throughout the round of golf. Simulator buildings are fully enclosed and affixed with a lightning rod to safely direct a lightning strike to ground. The simulator for tee shots and golf mats for the 2nd shot makes these golf shots completely unaffected by course conditions. Even with leaves covering most of the course, golfers will not lose balls from the tee shot due to leaves. The shorter course, combined with the use of the simulator and golf mats makes it possible to safely and easily play golf at night. Night Golf allows for more golfers to play the course per day which brings down the price golf courses must charge. Night golf is also attractive to young people. Large water hazards and sand bunkers as well as other design features normally built and maintained on the physical golf course can be easily incorporated into the simulator which provides infinite design options and challenges for the tee shot. The golf course designer is not limited by the size, topography and natural attributes of the land that the physical golf course is located on. A very large sand bunker in the landing area of the simulator can be transitioned to a very small miniaturized version of the water hazard or sand bunker in the physical landing area. This miniaturized version allows for the exact same challenge of hitting out of real sand without excessive land use and maintenance. A very large water hazard in the landing area of the simulator can be transitioned to a simple man-made, low maintenance imitation/representation or simple boundary of the water hazard on the physical course. This imitation shall be placed in the matching coordinates on the physical golf course compared to the coordinates of the simulated golf course. Large sand bunkers of the type normally used on traditional golf courses can be replaced with Composite Bunkers where the majority of the bunker is made using netting, artificial turf, rubber, fabric or other material that will facilitate collection of any golf balls entering the bunker. A small portion of the bunker is allocated for sand from where golfers will place their ball and take their next shot. This sand will be of the highest quality or else be of a synthetic material that replicates high quality sand. Delivering food and drink to simulator building lockers allows for golfers to purchase food/drink at check-in with a single transaction while they are paying for their round of golf. This eliminates the need for roaming food/drink carts which slows down pace of play. The single transaction and delivery at a later point in time encourages golfers to purchase food and drink they might not otherwise purchase. The simulator software can very precisely find the intersection between the margin of a hazard and the flight of a golfer's virtual tee shot. The software will project this intersection point to a spot on the ground on the simulator resulting in a precise "Reference Point" from which the ball for the next shot can be put into play. Replacing the tee shot with a simulated tee shot make Night Golf on a full length course possible. i.e. hitting the tee shot during the day or at night is no different. Note: Night Golf is generally played on smaller par 3 courses. The smaller sized course makes walking around the course easier and safer at night. Looking for tee shots in the dark is completely eliminated. Hitting second shots from designated mats allows for localized lighting in the area of the mats It should be noted that the terms "first", "second", and "third", and the like may be used herein to modify elements performing similar and/or analogous functions. These modifiers do not imply a spatial, sequential, or hierarchical order to the modified elements unless specifically stated.

While the disclosure has been described with reference to several embodiments, it will be understood by those skilled in the art that various changes may be made and equivalents may be substituted for elements thereof without departing from the scope of the disclosure. In addition, many modifications may be made to adapt a particular situation or material to the teachings of the disclosure without departing from the essential scope thereof. Therefore, it is intended that the disclosure not be limited to the particular embodiments disclosed as the best mode contemplated for carrying out this disclosure, but that the disclosure will include all embodiments falling within the scope of the appended claims.

What is claimed is:

1. A golf game system comprising:

a golf simulator, the golf simulator comprising a plurality of virtual tee locations adjacent to or on a virtual fairway;

two or more outdoor shortened physical golf holes programmed into the golf simulator located on or near the outdoor shortened physical golf hole, the two or more outdoor physical golf holes each comprising:

a physical fairway landing area;

a physical first rough landing area located adjacent to the fairway landing area;

a physical approach area adjacent to the fairway landing area;

a physical green adjacent to the approach area;

a physical cup in the green;

wherein the golf simulator is configured to allow a player to simulate a drive of a golf ball from a simulated tee location onto a fairway landing area or a rough landing area, and the golf simulator calculates where on the physical landing area the ball should be placed after the drive, and the golf simulator informs the player where to place the ball on the physical landing area, and wherein the golf simulator is configured for the two or more outdoor shortened physical golf holes to play as a pre-programmed or player selected par 4, or par 5 golf hole.

2. The golf game system of claim 1, wherein the shortened physical golf hole is shorter in length than a standard golf hole by about the length of the virtual fairway.

3. The golf game system of claim 1, wherein the shortened physical golf hole further comprises:

a structure selected from the group consisting of a simulator building, a tent, a gazebo, a shed, and lean-to, that houses the golf simulator that is located on or near either of the landing areas.

4. The golf game system of claim 3, wherein the structure comprises:

an exit door;

a projector;

a screen located on or near the exit door;

wherein the projector is in communication with the golf simulator, and the projector projects onto the screen an image of the outdoor shortened physical golf hole players will see upon exiting the structure.

5. The golf game system of claim 1, wherein the golf simulator is configured to create two or more golf holes using a single outdoor physical golf hole used in conjunction with two or more different simulated fairways.

6. The golf game system of claim 1, wherein the golf simulator further comprises:

a virtual sand bunker near the virtual fairway;

a physical miniature sand bunker located near the physical fairway landing area, wherein the miniature sand bunker has an actual size of about 1% to about 75% of the virtual size of the virtual sand bunker.

7. The golf game system of claim 1, further comprising:

a composite bunker located on the shortened physical golf course, the composite bunker comprising:

a sand shot area;

a physical boundary enclosing the sand shot area;

a drain located adjacent to the sand shot area and inside of the boundary;

sidewalls generally enclosing the drain and the boundary; and a set of steps leading down from outside of the sidewalls to a location adjacent to the sand shot area.

8. The golf game system of claim 7, wherein the sidewalls comprises material selected from the group consisting of artificial turf, netting, and fabric.

9. The golf game system of claim 1, further comprising:

an alternative water hazard, the alternative water hazard comprising:

a water hazard interior;

a plurality of water mark indicia located throughout the water hazard interior;

a border enclosing the water hazard interior; and a fence located adjacent to at least a portion of the border.

10. The golf game system of claim 9, wherein the water hazard interiors materials selected from the group consisting of artificial turf, alternate terrain, shallow water, painted grass, or standard golf course grass.

11. The golf game system of claim 9, wherein the plurality of water mark indicia are flags inserted into the water hazard interior.

12. The golf game system of claim 9, wherein the border comprises material selected from the group consisting of rocks, mulch, paint, rope, alternative terrain.

13. The golf game system of claim 1, wherein the golf simulator is configured to suggest a virtual pre-programmed tee location based on the player's average club distance, where the club is selected from the group consisting of a driver, a driving iron, and a fairway wood.

14. The golf game system of claim 13, wherein the golf simulator is configured to suggest a virtual pre-programmed tee location also based on additional data from the simulator where the data is chosen from the group consisting of player's average, median, range or standard deviation of distances, club face angles, swing speeds, smash factors, and angles of attack.

15. The golf game system of claim 1, wherein the golf simulator is configured to suggest a virtual pre-programmed tee location based on the player's total of average driver, driving iron, or fairway wood distance and average iron distance where the iron is chosen from the group consisting of a 4 iron, a5 iron, a 6 iron, a 7 iron, and an 8 iron.

16. The golf game system of claim 15, wherein the golf simulator is configured to suggest a virtual pre-programmed tee location also based on additional data from the simulator where the data is chosen from the group consisting of the player's average, median, range or standard deviation of distances, club face angles, swing speeds, smash factors, and angles of attack.

17. The golf game system of claim 1, wherein the golf simulator may add or subtract golf ball speed to the golfer's simulated tee shot based on simulator data of actual driver, driving iron, fairway wood, or iron shots hit into the golf simulator or based on user selection.

18. The golf game system of claim 1, wherein the golf simulator is configured as an option to add or subtract golf ball side spin and/or modify swing path to the golfers simulated tee shot based on side spin and swing path data of actual driver, driving iron, fairway wood or iron shots hit into the golf simulator or based on user selection.

19. The golf game system of claim 1, further comprising:
a plurality of indicia located on at least one of the physical fairway landing area and physical rough landing area.

20. The golf game system of claim 19, where the plurality of indicia are mats from which a second shot may be hit.

21. The golf game system of claim 20, further comprising:
a unique indicia for each mat on a shortened golf hole; and
wherein the location of each mat is programmed into the golf simulator.

22. The golf game system of claim 20, further comprising:
a zone of area associated with each a mat, each zone of area identified by the indicia of the associated mat; and
wherein the boundaries of each zone of area are defined in the golf simulator and are not visible on the physical golf course nor visible to the user in the golf simulator.

23. The golf game system of claim 19, wherein the golf simulator is configured to calculate the nearest indicia from which the ball should be placed after the drive.

24. The golf game system of claim 19 wherein the golf simulator is configured to calculate the distance and direction from a particular indicia where the ball should be placed after the drive.

25. The golf game system of claim 24 where the distance and direction are given in standard units of measure such as yards, feet or meters and direction is a combination of forward/back and left/right relative to the indicia while the player is facing towards the green.

26. The game system of claim 19, wherein the indicia has a marking convention that indicates where an indicia will be located on the landing area or rough landing area.

27. The game system of claim 26, wherein the marking convention is that indicia located in center of fairway are identified with even numbers; indicia located on the left or right side of fairway are identified with odd numbers.

28. The game system of claim 26, wherein the marking convention is that indicia located in the rough left of the fairway are identified such that the first indicia includes the letter "L", and indicia located in the rough right of the fairway are identified such that the first indicia includes the letter "R".

29. A golf game system comprising:
a golf simulator, the golf simulator comprising a plurality of virtual tee boxes adjacent to or on a virtual fairway;
an outdoor shortened physical golf hole programmed into the golf simulator located on or near the outdoor shortened physical golf hole, the outdoor shortened physical golf hole comprising:
a fairway landing area;
a rough landing area;
an approach area adjacent to the fairway landing area;
a green adjacent to the approach area;
a cup in the green;
a gps system in communication with the golf simulator;
a smart device app in communication with the golf simulator;
wherein the golf simulator is configured to allow a player to simulate a drive of a golf ball out of a simulated tee box onto the fairway landing area or rough landing area, and the golf simulator calculates where on the landing area the ball should be placed after the drive, and the golf simulator informs the player where to place the ball on the physical landing area via the smart device app and the gps system.

* * * * *